US008974111B2

(12) United States Patent
Phallen

(10) Patent No.: US 8,974,111 B2
(45) Date of Patent: Mar. 10, 2015

(54) METHOD AND APPARATUS FOR CONTINUOUS LIQUID STREAM BLENDING

(75) Inventor: Iver J. Phallen, Youngstown, NY (US)

(73) Assignee: Oden Machinery, Inc., Tonawanda, NY (US)

( * ) Notice: Subject to any disclaimer, the term of this patent is extended or adjusted under 35 U.S.C. 154(b) by 1782 days.

(21) Appl. No.: 11/986,569

(22) Filed: Nov. 21, 2007

(65) Prior Publication Data

US 2008/0144427 A1 Jun. 19, 2008

Related U.S. Application Data

(63) Continuation-in-part of application No. 11/125,807, filed on May 9, 2005, now Pat. No. 7,357,563.

(60) Provisional application No. 60/860,421, filed on Nov. 21, 2006.

(51) Int. Cl.

| | |
|---|---|
| ***B01F 3/08*** | (2006.01) |
| ***B01F 13/10*** | (2006.01) |
| ***B01F 5/02*** | (2006.01) |
| ***B01F 5/06*** | (2006.01) |
| ***B01F 15/04*** | (2006.01) |

(52) U.S. Cl.

CPC ..... *B01F 13/1055* (2013.01); *B01F 3/0865* (2013.01); *B01F 5/0256* (2013.01); *B01F 5/061* (2013.01); *B01F 15/042* (2013.01)

USPC ..... 366/160.3; 366/181.8

(58) Field of Classification Search

USPC ..... 366/154.1, 160.2, 160.3, 181.8, 182.2

See application file for complete search history.

(56) References Cited

U.S. PATENT DOCUMENTS

| | | | | |
|---|---|---|---|---|
| 2,036,810 | A * | 4/1936 | Hurrell | 366/160.3 |
| 4,106,115 | A * | 8/1978 | Takahashi et al. | 366/138 |
| 6,186,193 | B1 * | 2/2001 | Phallen et al. | 141/83 |

* cited by examiner

*Primary Examiner* — David Sorkin

(74) *Attorney, Agent, or Firm* — John C. Thompson; Sandra I. Thompson

(57) ABSTRACT

A method and apparatus for combining and mixing together a plurality of liquids to form a blend. The invention discloses reservoir supplied intermittently operated servo driven pumps, and optionally discrete liquid flow meters, and precise, encoded, fast-acting flow shut-off devices to create and define repeated time synchronized ratio defined doses of the liquids. One or more liquids, designated secondary streams, are synchronously dosed into a secondary streams injection assembly which is located generally at the suction port of the primary liquid stream dosing pump. The primary stream pump, during its synchronized intermittent operation, withdraws ratio defined primary stream and secondary stream liquids from the injection assembly. The primary stream pump serves also to propel the combined liquids ratio dosed streams into and through mixing structure on the discharge of the primary stream pump. The mixed streams are then received by a final blend tank of desired capacity where blended liquids are available for use on a continuous stream or continuous flow basis, at any flow rate up to a defined maximum. The entire blender apparatus may be started at will and stopped at the completion of any given time synchronized streams ratio dose cycle.

37 Claims, 18 Drawing Sheets

RESERVOIR BREATHER
RESERVOIR BREATHER
BULK SUPPLY PORT
RESERVOIR BREATHER
CONTINUOUS STREAM BLENDED PRODUCT 0-200 GPM
WAIT
RUN
L.C.
MAX
MIN
25 GALLONS @ 100 GPM
50 GALLONS @ 200 GPM
RESERVOIR BREATHER
BULK SUPPLY PORT
10
12
12P
14
16
18
20
24
26
28
32
34
35
36
38
40
42A
42B
44
44A
46
48
50
50A
52A
52B
54
56

RESERVOIR BREATHER
24
MAX
MIN
12
12P
20
28
74
32
35
34
36
44A
48
44
42A
42B
48
RESERVOIR BREATHER
26
16
BULK SUPPLY PORT
L.C.
44A
40
38
RESERVOIR BREATHER
52A
50A
50
52B
WAIT
RUN
L.C.
18
CONTINUOUS STREAM BLENDED PRODUCT 0-200 GPM
25 GALLONS @ 100 GPM
50 GALLONS @ 200 GPM
54
56
RESERVOIR BREATHER
14
BULK SUPPLY PORT
10

POWDER COMPONENT
76
RESERVOIR BREATHER
MAX
MIN
24
48
82
78
80
12
12P
32
84
20
28
35
34
36
44
44A
48
50A
50
42A
42B
RESERVOIR BREATHER
L.C.
26
16
BULK SUPPLY PORT
38
40
52A
52B
14
RESERVOIR BREATHER
BULK SUPPLY PORT
WAIT
RUN
18
CONTINUOUS STREAM BLENDED PRODUCT 0–200 GPM
25 GALLONS @ 100 GPM
50 GALLONS @ 200 GPM
54
56
10

RESERVOIR BREATHER
24
MAX
MIN
12
12P
20
28
48
32
35
42A
42B
34
36
44A
48
44
50A
50
52A
L.C.
40
38
26
16
BULK SUPPLY PORT
RESERVOIR BREATHER
CONTAINER
14
10

FIGURE 10A
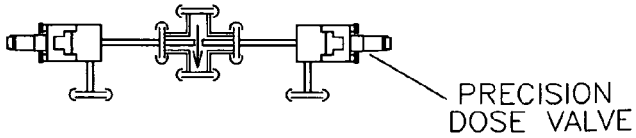
FIGURE 10B
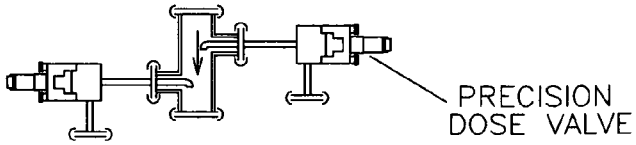
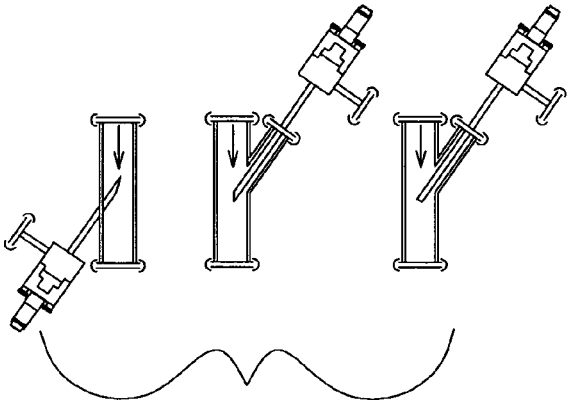
FIGURE 10C
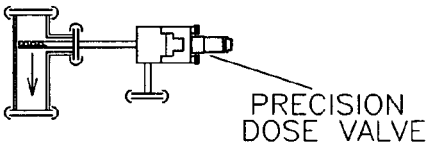
FIGURE 10D
FIGURE 10E
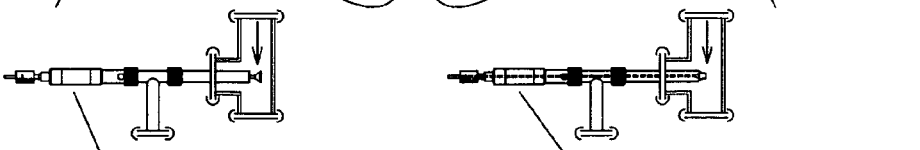
OUTWARD OPENING FLOW END
SHUTOFF PRECISION DOSE VALVE
FIGURE 10F
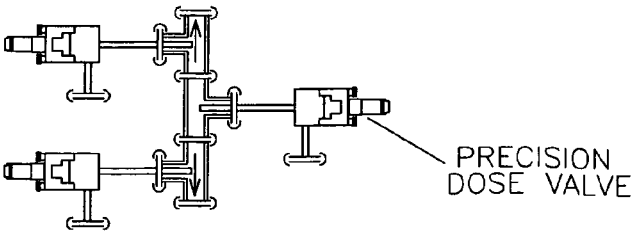

RESERVOIR BREATHER
24
MAX
MIN
48
12
12P
32
20
28
42A
42B
35
86
34
36
44
44A
48
50A
50
52A
52B
RESERVOIR BREATHER
26
16
BULK SUPPLY PORT
L.C.
40
38
RESERVOIR BREATHER
14
BULK SUPPLY PORT
RESERVOIR BREATHER
WAIT
RUN
L.C.
18
CONTINUOUS STREAM BLENDED PRODUCT 0–200 GPM
54
56
25 GALLONS @ 100 GPM
50 GALLONS @ 200 GPM
10

RESERVOIR BREATHER
MAX
MIN
24
12
12P
20
28
48
42A
42B
32
86C
86B
35
34
36
44
44A
48
50A
50
52A
52B
40
38
L.C.
26
16
BULK SUPPLY PORT
RESERVOIR BREATHER
14
10
WAIT
RUN
18
CONTINUOUS STREAM BLENDED PRODUCT 0-200 GPM
25 GALLONS @ 100 GPM
50 GALLONS @ 200 GPM
54
56

RESERVOIR BREATHER
MAX
MIN
24
12
12P
20
28
48
32
42A
42B
35
34
36
44
44A
48
50A
50
52A
52B
40
38
L.C.
26
16
BULK SUPPLY PORT
RESERVOIR BREATHER
14
10
WAIT
RUN
18
CONTINUOUS STREAM BLENDED PRODUCT 0–200 GPM
25 GALLONS @ 100 GPM
50 GALLONS @ 200 GPM
54
56

METHOD AND APPARATUS FOR CONTINUOUS LIQUID STREAM BLENDING

CROSS-REFERENCE TO RELATED APPLICATIONS

The present invention is a continuation-in-part of U.S. application Ser. No. 11/125,807 filed May 9, 2005, now U.S. Pat. No. 7,357,563 the subject matter of which is incorporated herein by reference thereto. In addition, this application claims the benefit under 35 U.S.C. §119(e) of U.S. provisional patent application Ser. No. 60/860,421, filed Nov. 21, 2006.

TECHNICAL FIELD

The present invention relates generally to a method and apparatus for the combining and mixing together of two or more liquids to form a batch or blend of desired ratios or proportions. More, specifically, the invention discloses the use of reservoir supplied intermittently operated servo driven pumps, and optionally discrete liquid flow meters, and precise, encoded, fast-acting flow shut-off devices to create and define repeated time synchronized ratio defined doses of two or more liquids. One or more liquids, designated secondary streams, are synchronously dosed into a secondary streams injection assembly which is located generally at the suction port of the primary liquid stream dosing pump. The primary stream pump, during its synchronized intermittent operation, withdraws ratio defined primary stream and secondary stream liquids from the injection assembly. The primary stream pump serves also to propel the combined liquids ratio dosed streams into and through mixing elements or apparatus on the discharge of the primary stream pump. The mixed streams are then received by a final blend tank of desired capacity where blended liquids are available for use on a continuous stream or continuous flow basis, at any flow rate up to a defined maximum. The entire blender apparatus may be started at will and stopped at the completion of any given time synchronized streams ratio dose cycle. Within the scope of the invention, provision is also made for the combining of one or more solids or powders with one or more liquids.

Because of the novel and simplified separation of streams ratio dose combining pressures on the suction side of a primary stream pump, from the pressure required on the discharge of the primary stream pump to effect streams mixing, a broad range of liquids and formulas can be blended using a blender apparatus of the present invention which is substantially simpler than known prior art blenders. Thus, manufacturing agility and versatility are enhanced by this new, improved, and simplified blender invention and the cost of the blender invention can be reduced when compared with blenders of the prior art of equivalent capacity, due to the elimination of significant elements and apparatus as a result of the simplification embodied in the new invention. The cost of the new blender invention is further reduced where volumetric operation is allowed, in that the new design can operate volumetrically and without the need for separate and discrete flow meters. The simplified liquid flow pathway of the new blender invention also allows easier cleaning and faster changeover and lower volume effluents, all important attributes and improvements in many applications.

BACKGROUND OF THE INVENTION

The combining of two or more liquids together to form a defined mixture of the constituent liquids is fundamental to many industrial processes and commercial products. This combining of liquids may be referred to as batching or blending and is common to many industrial segments including pharmaceutical products, biomedical products, food processing products, household products, personal care products, petroleum products and lubricants, chemical products, and many other general industrial, commercial, and consumer liquid products.

Most typically, liquid products are made by combining relatively large quantities of each constituent. Constituent liquids are held in large tanks and are moved in correct volumetric or weight ratio into another large tank where mixing of the liquids occurs. This general process is referred to as batching.

The many drawbacks and limitations of liquids batching are well detailed and discussed in U.S. Pat. No. 6,186,193 B1, column 1, line 47, to column 2, line 7. These discussions are thus incorporated into this specification by reference.

Because of the numerous and substantial shortcomings and limitations of liquid products batch processing, alternative means of liquid products manufacturing have been sought. One alternative method to batching is termed continuous stream blending.

Continuous stream blending embodies the notion of combining constituent liquids to form a liquid product only as needed or on a demand basis. Essentially, product is made only as required and at the flow rate required. The flow rate required is typically based on the demand of the liquid filling machine packaging the liquid product, or by the process or utilization demand or consumption rate of the blended liquid product.

The appeal and merit of a continuous stream blending system, as distinct from a batching system, is clear. The ability to eliminate large liquid product batch preparation and holding tanks leads to a small system volume, more product compounding flexibility, faster product species turnaround, smaller and shorter practical packaging run capabilities, and a substantially lower capital asset commitment. Continuous stream blending can also yield superior product formula accuracy and quality, and can eliminate the barrier or "wall" between liquid products processing and liquid products packaging, as well as greatly reduce waste, cleanup time, and effluent volumes. Furthermore, mixing is simplified and product aging effects are largely eliminated. The real issue is how to build a continuous stream blending system with the maximum degree of accuracy, flexibility of use, and versatility of application in a broad range of commercial sectors, and with the best possible simplicity of design and function and ease of use.

The numerous designs for continuous stream blending that have been previously disclosed in the commercial and patent art are set forth in substantial detail in U.S. Pat. No. 6,186,193 B1 at column 2, line 36, to column 4, line 16. The problems and limitations of these designs are also therein reviewed. This section of U.S. Pat. No. 6,186,193 B1 is thus incorporated into the present specification by reference.

The prior art also includes U.S. Pat. No. 6,186,193 B1, in which Phallen et al disclose an invention consisting "of a method and apparatus providing for the continuous stream blending, preferably on a mass ratio basis, of two or more liquids. Each individual liquid stream is synchronously dosed in precise mass ratio to a common mixing point. The flow of each stream is on-off or digital. Repeated mass ratio doses of defined and matching flow interval, referred to as synchronous digital flow, interspersed with a defined interval of no flow, constitutes digital flow at a net rate sufficient to meet or exceed some required take-away of the blended liquids. In one preferred embodiment, each dose stream flow is produced and measured by an apparatus preferably consisting of a device for initiating liquid flow in the form of a controller and a servomotor-driven precision positive displacement pump, the apparatus further including a Coriolis mass meter and a precision flow stream shut-off device. The servomotor and controller establish and control a periodic and intermittent flow rate necessary to displace a defined mass dose in a precisely defined flow interval. The flow interval is measured against a precision millisecond digital clock. The Coriolis mass meter is used only to totalize mass flow to define the desired mass dose during the defined digital flow interval. The flow stream shut-off device ensures precise delivery of the mass dose to the common mixing point. "The flow rate of a stream is automatically adjusted by the control electronics until the required mass dose is delivered in the defined flow interval" (column 7, line 41 to line 67):

"Because each flow stream starts and stops simultaneously regardless of the mass dose associated with each stream, blending or mixing of the streams at a common intersection to a defined mass ratio formula is facilitated by the simultaneous and kinetic collision and resultant mixing of the coincident flows in a mixing chamber. The blending apparatus can be started at will and can be stopped at the end of each defined dose interval, typically every 5000 mS. This method allows the apparatus to be operated in liquids process environments where frequent stop and start conditions are prevalent, without any penalty or error in mass ratio accuracy or blending efficacy. Use of PLC or PC system control in conjunction with a precision millisecond (1000 Hz) clock signal allows automatic establishment of a mass dose and flow stream synchronization at start up, as well as self-checking and correction of mass dose and flow synchrony with each digital flow cycle. Operation is preferably based upon a mass ratio recipe or formula, although the control software also provides for conversion of volumetric formulas to mass. The apparatus automatically adapts to changes in take-away flow rate by varying the off time or no flow interval between synchronous digital doses, thus eliminating manual or electronic adjustment or recalibration of the liquid flow streams as take-away demand varies" (column 8, line 1 to line 24).

In U.S. Pat. No. 6,186,193 B1, Phallen teaches a continuous stream blending design in which first stage streams mixing occurs by hydraulically combining the streams in a kinetic mixing chamber, with second stage streams mixing occurring by hydraulic flow and displacement of the streams from the kinetic mixing chamber through a second mixing device which is, in turn, hydraulically connected to a finished blend tank.

In Phallen's invention, the motive force to move the liquids into and through the kinetic mixing chamber and through a mixing device and onward into the finished blend tank, is derived solely from the streams ratio dosing pumps. Essentially, the combined pumped flow from all of the stream pumps supplies all of the energy to move the liquid streams to and through the combining and blending portions of the apparatus and, after streams combining, on through the connecting conduit into the terminus of the system represented by the finished blend tank. In the Phallen design there is no other or additional pump or other motive force inducing liquid flow through the apparatus (see FIG. 3 of this specification which shows this prior art arrangement).

The hydraulic nature of the Phallen patent is clear. As a hydraulic design, the entire fluid flow pathway, from the bulk supply source tank of each stream to the finished blend tank, is charged with the liquids being combined. There are no intentional gas voids or other breaks in the fluid flow pathway in any part of the system.

Although the design taught by Phallen represents an advancement in the state-of-the-art and has had commercial success, limitations and constraints have emerged.

Among the limitations of the U.S. Pat. No. 6,186,193 B1 invention, the most evident center on the completely hydraulic design of the fluid flow pathway of the apparatus. Because of the hydraulic design, streams flow rates are influenced by changing back pressures, which are, in turn, fundamentally influenced by varying viscosities, rheologies, temperatures, and so forth.

Because the system is hydraulic, every variation or disturbance or change in operating conditions is evident in every other part of the system. Each and every part of the system fluid flow pathway is hydraulically connected, one to the other. Thus, a change in flow on any stream represents an essentially instantaneous change in the flow resistance or back pressure acting on every other flow stream. In effect, every stream is "visible" to every other stream. Thus, each manual or automatic performance adjustment on a given stream acts upon and alters the conditions of flow on the remaining streams. Moreover, the performance change on a given stream is directly contradictory to the setpoint requirements of the other flow streams. Thus, a reduced flow on one stream lowers the overall system hydraulic pressure. This pressure decrease tends to increase dose ratio flow on the remaining flow streams, which then forces a flow rate adjustment to be made on these streams. Conversely, an increased flow on one stream increases the overall system hydraulic pressure. This pressure increase tends to lower dose ratio flow on the remaining flow streams, which then forces a flow rate adjustment to be made on these streams.

In U.S. Pat. No. 6,186,193 B1, Phallen also teaches a design which provides for the ability to sample each stream by direct ratio dose collection to atmosphere at the point of hydraulic combining of each stream into the kinetic mixing chamber. The purpose of this sampling is twofold. First, it provides the means to empirically compare an actual dose mass with the dose mass displayed by the Coriolis mass flow meter, thus proofing the meter and its scaling and calibration. The second purpose of this sampling capability is to provide means to directly measure and verify each dose ratio as delivered into the kinetic mixing chamber. However, with the system in operation, pressure in the kinetic mixing chamber is substantially above atmosphere. This is particularly true with higher viscosity liquids. Because this is true, the sample ratio dose delivered to atmosphere often will not correspond closely to the ratio dose delivered at the higher kinetic mixing chamber pressure when the stream flow rate and delivery time for each condition are held constant. Thus a significant flow rate adjustment must be made for correct dose flow into the kinetic mixing chamber, and direct empirical sampling is not possible.

Another limitation of the Phallen invention is a direct consequence of the hydraulic design. Because the streams pumps supply the flow energy to propel each liquid stream through the system all the way to the finished blend tank, the back pressure on the overall system and upon each stream is determined by the flow structure of the system, principally distal to the streams pumps. The flow structure most prominent in determining this back pressure is the mixing element downstream from the kinetic mixing chamber. In most instances, this mixing element consists of a static mixing device. These types of mixing devices, by their nature, impose a substantial flow restriction and, thus, create a high back pressure. This is particularly true with higher viscosity liquids. Because the stream pumps are the only means of creating flow through the mixing structures of the design, a high or elevated back pressure environment is imposed upon each stream ratio dosing pump. This condition is unfavorable to best ratio dosing accuracy, stability, and repeatability of the ratio dosing pumps. Further, induced back pressures are difficult to predict as a function of changing liquid formulas and constituent liquid components and of changing flow rates and conditions. Changing requirements or conditions relative to liquid viscosities are of particular concern in predicting and controlling system operating pressures.

Another negative aspect of the fluid flow pathway of the Phallen invention is that if additional mixing capability must be added to achieve streams mixing efficacy with a particular liquid formula, back pressures will be substantially increased on all parts of the system, including the streams ratio dosing pumps. This problem can be particularly severe where high viscosity liquids are generally harder to mix together and require more mixing elements for thorough combining. This, in turn, causes a dramatic increase in flow resistance and back pressure acting on the streams ratio dosing pumps.

In U.S. application Ser. No. 11/125,807 filed May 9, 2005, Phallen discloses "An Improved Continuous Liquid Stream Blender" where the problems of interactive streams hydraulic back pressure are overcome by " . . . use of intermittently operated servo driven pumps, flow meters, and precise fast-acting flow shut-off devices to create repeated time synchronized ratio defined doses of two or more liquids flowing into a common constant pressure streams combining chamber. The synchronized intermittent doses are synchronously removed from the combining chamber at a flow rate matching the summed flow rate of the doses flowing into the chamber and are then displaced through a mixing element" (P1, line 7 to line 13).

In Ser. No. 11/125,807, the ratio doses flowing synchronously into a constant pressure combining chamber are synchronously removed from the chamber by a mix stage pump (P12, line 33 to P13, line 5). This arrangement separates liquid streams ratio combining from streams mixing. Thus, at P13, line 6 to line 25, the inventor states "maintaining the dose streams combining chamber 40 at a constant pressure in order to optimize streams ratio dosing accuracy and stability is achieved by exactly matching the outflow of liquids from the chamber 40 to the streams inflow rates into the chamber. This is done by causing the flow rate from the mix stage pump 42 to exactly match the combining streams ratio dosing flow rate. This flow rate matching, in turn, is generally accomplished by maintaining the combining chamber liquid level at an essentially constant height within the chamber via level controller 36. In addition, component supply levels are also maintained at an essentially constant height by level controllers 28. By this arrangement, the dose stream pressures are optimally low and invariant, while the typically high and less stable back pressures associated with streams mixing are divorced and isolated from the dose streams. Effectively, the mix pump can be sized as necessary to deal with the relatively high mixing back pressure requirements without in any way compromising the desired low pressure optimization of the ratio dosed streams. With this arrangement, there can be no loss of precision in the mechanical combining of the ratio doses. Since there is no flow through the mix pump unless there is matching inflow into the streams combining chamber, the flow streams remain mechanically synchronized in terms of linear flow motion and thus combine in ratio on a flow through basis essentially as though they were directly combined on a hydraulic basis without use of a flow through streams combining chamber" (see FIG. 4 of this specification which shows this prior art arrangement).

The blender invention taught by Phallen in Ser. No. 11/125,807 solves the problems of flow streams ratio dose interaction and divorces flow streams ratio combining from flow streams mixing. Nevertheless, although it represents an improvement in the state-of-the-art and has been commercialized, limitations and constraints associated with the invention have become evident. The solution invented by Phallen involves a three stage blender, consisting of the ratio dosing elements, the combining chamber and mix stage pump, and the final blend tank. Thus, a level of mechanical complexity is found in the combining chamber and mix pump, and in the controls structure and electronics needed to match and maintain the liquids flow into the combining chamber with the mix pump mediated outflow. The extensive addition of apparatus and relatively complicated flow matching controls leads to a much greater economic cost associated with the solution, thus reducing its utility. The additional apparatus used in Phallen's invention to resolve the described problems further impairs the utility of the blender by markedly increasing its system volume and complicating and prolonging the clean-in-place flow sequences, cycles, and volumes needed to clean the blender liquid flow pathways.

With these problems and limitations of the prior art in mind, the present simplified blender invention, and the unique and novel aspects of its embodiments will now be fully discussed and disclosed. In this regard it is a particular objective of the new invention to incorporate and preserve the operable and functional advantages of the digital flow ratio dose blender operating format and associated features and capabilities as set forth by the specification of U.S. Pat. No. 6,186,193 B1 and of pending specification Ser. No. 11/125,807, both of which are thus incorporated herein by reference.

OBJECTS AND SUMMARY OF THE INVENTION

It is a primary object of the present invention to set forth a Simplified Continuous Liquid Stream Blending System which overcomes the numerous disadvantages, as set forth above, of presently known continuous liquid stream blending methods, apparatus, and prior art.

More particularly, the primary objects of the present invention include:

1. To disclose a unique and novel continuous outflow stream liquids blending method and apparatus wherein the liquid flow through the apparatus may be subdivided into a reservoir supplied primary stream ratio dosing apparatus; one or more secondary stream ratio dosing assemblies synchronously flowing into a streams injection assembly proximate to the infeed side of the primary stream ratio dosing pump; a streams combining and mixing assembly in the discharge flow pathway of the primary stream pump; and a finished blend product tank from which continuous outflow of the ratio combined and blended liquids is available.
2. To disclose a unique and novel continuous outflow stream liquids blending method and apparatus in which the liquid ratio dose flow from one or more secondary streams is synchronously combined with the liquid ratio dose flow in a primary stream, the streams combining occurring on a liquid into liquid basis in a structure termed the streams injection apparatus, which is located generally proximate to the suction port of the primary stream pump.
3. To disclose a unique and novel continuous outflow stream liquids blending method and apparatus in which synchronous ratio dose flow of each stream causes the linear flow velocity of each constituent stream flowing through the injector apparatus to be matched.

4. To disclose a unique and novel continuous outflow stream liquids blending method and apparatus in which the problem of variable back pressure acting upon the secondary streams is eliminated by the liquid into liquid flow combination of the secondary streams into the primary stream at the inflow side of the primary stream ratio dosing pump.

5. To disclose a unique and novel continuous outflow stream liquids blending method and apparatus in which it can be empirically shown that with synchronous liquid into liquid combining of secondary streams into the suction side of the primary stream pump, the ratio dose of one or more secondary streams can be changed without effect on the ratio dose of any other minor stream.

6. To disclose a unique and novel continuous outflow stream liquids blending method and apparatus in which it can be empirically shown that with synchronous liquid into liquid combining of secondary streams into the suction side of the primary stream pump, the ratio dose of one or more minor streams can be changed without changing the combined streams volumetric output dose of the primary stream pump.

7. To disclose a unique and novel continuous outflow stream liquids blending method and apparatus in which secondary ratio dose streams can remain in place and functional within the blender apparatus, but can be selectively turned on and off as desired and in any combination to alter the blend constituent streams as desired.

8. To disclose a unique and novel continuous outflow stream liquids blending method and apparatus wherein synchronously injecting secondary stream ratio doses into the injection assembly located at the suction side of the primary stream pump allows absolute separation of ratio dose pressures from the discharge pressure acting on the primary stream pump, such that one cannot hydraulically act on or alter the other.

9. To disclose a unique and novel continuous outflow stream liquids blending method and apparatus wherein synchronous flow of a primary stream liquid and one or more secondary stream liquids into a streams injection assembly which is located on the suction side of a primary stream pump allows the injection assembly to be maintained at a relatively constant operating pressure.

10. To disclose a unique and novel continuous outflow stream liquids blending method and apparatus wherein the constant operating pressure of the streams injection assembly is common to and essentially the same for each of the ratio dose streams flowing synchronously into the assembly.

11. To disclose a unique and novel continuous outflow stream liquids blending method and apparatus wherein the flow rate or ratio dose size of any one stream flowing synchronously into the streams injection apparatus is essentially unaffected by the flow rate or ratio dose size of any other stream or combination of streams flowing into the streams injection apparatus.

12. To disclose a unique and novel continuous outflow stream liquids blending method and apparatus in which direct stream ratio dose sampling is possible because of the repeatable and stable back pressure produced by each stream, and because each stream back pressure is non-interactive with any other.

13. To disclose a unique and novel continuous outflow stream liquids blending method and apparatus in which direct stream ratio dose sampling ability allows the blender invention to operate on a volumetric or mass ratio basis where each stream ratio dose is calibrated and established by measuring the sampled stream ratio dose volume or by weighing the sampled stream ratio dose.

14. To disclose a unique and novel continuous outflow stream liquids blending method and apparatus in which the blender invention can operate volumetrically without use of separate and discrete liquid flow meters or flow measurement devices apart from the servomotor-driven ratio dosing pump associated with each stream.

15. To disclose a unique and novel continuous outflow stream liquids blending method and apparatus in which the blender invention can operate either on a volumetric ratio dose basis or on a mass ratio dose basis through the use of any suitable type of volumetric or mass liquid flow meter inserted into the servo-pump discharge flow pathway of each stream.

15A. To disclose a unique and novel continuous outflow stream liquids blending method and apparatus in which the blender invention can be operated on a volumetric ratio dose or mass ratio dose basis through use of any suitable type of volumetric or mass liquid flow meter inserted into the servo-pump discharge flow pathway of each secondary stream and between the outfeed port of the primary stream ratio dose liquid supply reservoir and the stream's injector assembly.

16. To disclose a unique and novel continuous outflow stream liquids blending method and apparatus in which each stream sample valve can be located in a relatively symmetrical manner to the corresponding stream injection or ratio dose valve, and both stream valves are distal to all other flow elements common to the stream, together assuring equivalent dosing from either valve.

17. To disclose a unique and novel continuous outflow stream liquids blending method and apparatus in which the primary stream sample valve is essentially identical to the primary stream fast-acting positive shut-off dose valve located proximate to the finished blend tank, and where the sample valve is located on the same flow leg as the dose valve and down flow from it, thus allowing sampling of the blended liquids streams with minimal or no flow of incorrectly ratio matched or incompletely blended streams into the final blend tank.

18. To disclose a unique and novel continuous outflow stream liquids blending method and apparatus wherein flow through the streams mixing element or apparatus is supplied only by the primary stream pump, independent of any secondary stream flow pressure or apparatus.

19. To disclose a unique and novel continuous outflow stream liquids blending method and apparatus wherein flow from secondary streams supplies no flow or liquid propulsive force through the mixing elements of the apparatus.

20. To disclose a unique and novel continuous outflow stream liquids blending method and apparatus wherein the primary stream ratio dosing pump also serves as the streams mixing pump.

21. To disclose a unique and novel continuous outflow stream liquids blending method and apparatus in which the number and nature of streams mixing elements or devices located on the discharge of the primary stream pump can be added to or deleted from or altered as desired without altering the secondary streams ratio doses.

22. To disclose a unique and novel continuous outflow stream liquids blending method and apparatus wherein the synchronous ratio dose flow from any one secondary stream or any combination of secondary streams into the streams injection apparatus does not alter or influence the operating pressure of the injection apparatus when the blender is in operation.

23. To disclose a unique and novel continuous outflow stream liquids blending method and apparatus wherein the flow of liquids through the apparatus of invention is arranged so that a change in the flow rate, discharge pressure, ratio dose size or rheology of liquid synchronously flowing through any stream has no effect or influence upon liquid flow in any other stream functioning within the apparatus of invention.

24. To disclose a unique and novel continuous outflow stream liquids blending method and apparatus wherein the number of liquid stream pumps required to completely implement the blender apparatus of invention is equivalent to the number of liquid streams to be blended.

25. To disclose a unique and novel continuous outflow stream liquids blending method and apparatus wherein any ratio dose stream apparatus producing flow into or through the streams injection apparatus adjacent to the suction port of the primary stream pump can be scaled and configured as required to synchronously deliver the requisite ratio dose at the requisite flow rate into and through the streams injection apparatus without any influence upon the necessary scaling and configuration of any other ratio dose stream apparatus producing flow into or through the same streams injection apparatus.

26. To disclose a unique and novel continuous outflow stream liquids blending method and apparatus wherein the liquid flowing into each stream ratio dosing pump is preferably supplied from a discrete level controlled reservoir forming a part of the blending stream apparatus, each reservoir preferably proximate to each stream ratio dosing pump.

27. To disclose a unique and novel continuous outflow stream liquids blending method and apparatus wherein each stream liquid supply reservoir is preferably provided with a liquid level control allowing liquid level within the reservoir to be maintained at a defined and known liquid level or within a defined and known liquid level range.

28. To disclose a unique and novel continuous outflow stream liquids blending method and apparatus in which a dual point liquid level sensor associated with a stream supply reservoir can define a known volume, such that the time to refill the reservoir from a minimum point to a maximum point can quantify a reservoir supply flow rate, thus allowing continuing monitoring and confirmation that the stream liquid is being supplied to the blender stream pump at a rate equal to or greater than required.

29. To disclose a unique and novel continuous outflow stream liquids blending method and apparatus wherein use of a level controlled liquid supply reservoir for each blender constituent stream establishes a definite and known and stable liquid feed or supply pressure or pressure range to each stream pump, thus helping to assure accurate and stable operation of the blender invention.

30. To disclose a unique and novel continuous outflow stream liquids blending method and apparatus wherein the pressure acting upon the liquid in each dose stream reservoir is preferably atmospheric pressure.

31. To disclose a unique and novel continuous outflow stream liquids blending method and apparatus wherein the pressure acting on the dose streams within the lumen of the streams injector apparatus is principally and preferably the hydrostatic liquid column pressure exerted by the primary stream liquid supply reservoir and reservoir outfeed plumbing, in the case where the primary stream liquid supply reservoir is at atmospheric pressure.

32. To disclose a unique and novel continuous outflow stream liquids blending method and apparatus wherein the pressure acting on the dose streams within the lumen of the streams injector apparatus can be at a specified and controlled and maintained pressure above atmospheric pressure by application of a pressure to the liquid in the primary stream liquid supply reservoir.

33. To disclose a unique and novel continuous outflow stream liquids blending method and apparatus wherein liquid flow out of the streams injector apparatus is only from the suction flow of the primary stream pump acting on the outfeed of the injector apparatus, and not from the synchronous flows of the secondary ratio dose streams.

34. To disclose a unique and novel continuous outflow stream liquids blending method and apparatus wherein any secondary stream liquid supply reservoir can be pressurized at a relatively constant pressure above atmosphere as required.

35. To disclose a unique and novel continuous outflow stream liquids blending method and apparatus wherein a change in the pressure in any secondary stream liquid supply reservoir, causing a change in ratio dose flow in that stream, will have no effect or influence upon the ratio dose flow of any other stream.

36. To disclose a unique and novel continuous outflow stream liquids blending method and apparatus wherein the primary stream ratio dosing pump can be sized and scaled and configured to provide the required combined total ratio dose flows of all constituent liquid blend streams from the streams injection assembly on the suction side of the primary stream pump and out of the primary stream pump discharge and into the blender mixing elements, and through the primary stream flow meter (if utilized) and on through the precision dose valve and into the finished blend tank, such sizing having no influence upon the scaling and configuration of any secondary ratio dose stream apparatus.

37. To disclose a unique and novel continuous outflow stream liquids blending method and apparatus wherein one or more streams mixing elements can be located within the streams injection assembly or downstream of the streams injection assembly but before the suction side infeed port of the primary stream ratio dose pump.

38. To disclose a unique and novel continuous outflow stream liquids blending method and apparatus wherein one or more streams mixing elements or apparatus are located on the discharge side of the primary stream ratio dose pump.

39. To disclose a unique and novel continuous outflow stream liquids blending method and apparatus wherein the nature and configuration of any mixing elements or apparatus located on the discharge side of the primary stream ratio dose pump has no effect upon the ratio dose flow of any secondary ratio dose stream flowing into the streams injection assembly.

40. To disclose a unique and novel continuous outflow stream liquids blending method and apparatus wherein the summed flow rate of all ratio dose streams flowing synchronously into or through the streams injection apparatus is exactly equivalent to the synchronous flow rate of the combined streams flowing from the discharge of the primary stream ratio dose pump, provided the summed flow of all secondary ratio dose streams is less than that of the summed flow of all streams.

41. To disclose a unique and novel continuous outflow stream liquids blending method and apparatus wherein a streams injector assembly is located between the liquid supply reservoir of the primary stream and the infeed port of the primary stream pump.

42. To disclose a unique and novel continuous outflow stream liquids blending method and apparatus wherein the injector assembly consists of a cylindrical shaped flow tube having an internal flow lumen with one or more internal diameters, and a liquid injector flow structure or port corresponding to each secondary flow stream.

43. To disclose a unique and novel continuous outflow stream liquids blending method and apparatus wherein the streams ratio doses are combined synchronously at ratio matched flows within the flow lumen of the injector assembly.

44. To disclose a unique and novel continuous outflow stream liquids blending method and apparatus wherein the liquid flow rate discharged from primary streams pump must be equal to the flow rate of liquid entering the primary streams pump.

45. To disclose a unique and novel continuous outflow stream liquids blending method and apparatus wherein a fast-acting positive shut-off dose valve is located in the discharge flow pathway of the primary stream pump distal to all mixing elements or apparatus in that pathway and distal to any flow meter in that pathway, and proximate to the finished blend tank; the valve being closed when there is no flow through the apparatus, thus serving to prevent flow through all portions of the primary stream flow pathway.

46. To disclose a unique and novel continuous outflow stream liquids blending method and apparatus wherein the flow of all of the ratio defined and synchronized streams through the primary stream pump contributes to the streams combining and mixing due to the mixing action of the pump.

47. To disclose a unique and novel continuous outflow stream liquids blending method and apparatus wherein a single control signal serves to operate and synchronize the ratio matched dose flows of all functioning streams within the blender apparatus.

48. To disclose a unique and novel continuous outflow stream liquids blending method and apparatus wherein priming of the blender fluid flow pathway with liquids is accomplished by first measuring or computing the total lumen volume of each respective stream, and then rotating each respective stream ratio dosing pump, each pump having a known volumetric liquid displacement per increment of revolution, sufficiently to displace a volume of liquid for each stream equal to or preferably greater than each stream lumen volume.

49. To disclose a unique and novel continuous outflow stream liquids blending method and apparatus wherein priming of the blending apparatus flow pathway with liquids is accomplished sequentially wherein: first, each respective liquid supply reservoir is charged with liquid to the indicated maximum level of the reservoir liquid level control; second, the primary stream is primed to a fully hydraulic condition to achieve flow into the finished blend tank and also from the discharge of the primary stream sample nozzle; third, each secondary stream is primed to a hydraulic condition based upon its lumen volume until a fully hydraulic condition is achieved allowing flow into the lumen of the injector assembly and also from the secondary stream sample nozzle; fourth, operating all functioning ratio streams synchronously to displace ratio blended flow from the primary stream sample nozzle thus allowing calibration of each stream and the finished blend liquid; fifth, synchronously ratio dose operating all functioning streams of the blender to effect displacement of correctly blended liquid into the finished blend tank; this priming and charging sequence minimizing the consumption of all constituent liquids and minimizing the volume of unblended or incorrectly blended liquid entering the finished blend tank.

50. To disclose a unique and novel continuous outflow stream liquids blending method and apparatus wherein the stream volume or mass of a ratio defined digital dose can be increased, with proportionate increase in ratio dose size of all other streams, for the purpose of improving the stream ratio dose repeatability expressed as a plus or minus percentage of a ratio dose sample group mean; this being termed formula inflation.

51. To disclose a unique and novel continuous outflow stream liquids blending method and apparatus wherein formula inflation can be achieved by proportionately increasing the flow rates of all ratio dose streams within the established synchronous dose flow time, this being termed flow rate formula inflation.

52. To disclose a unique and novel continuous outflow stream liquids blending method and apparatus wherein formula inflation can be achieved by holding the established flow rates of all ratio dose streams constant, and increasing the synchronous dose flow time, this being termed flow time formula inflation.

53. To disclose a unique and novel continuous outflow stream liquids blending method and apparatus wherein the residence time of blended liquids in a dynamic mixing apparatus located in the discharge pathway of the primary stream pump can be completely defined and established as desired by the volumetric relationship of the blended liquids combined ratio dose and the internal volume of the dynamic mixing apparatus.

54. To disclose a unique and novel continuous outflow stream liquids blending method and apparatus in which multiple blenders of the present invention, each consisting of a primary stream and at least one secondary stream, can be combined or cascaded sequentially to allow more complex liquids blending and mixing arrangements, such combinations being termed multistage, or multi-tier, or multilevel blender architecture.

55. To disclose a unique and novel continuous outflow stream liquids blending method and apparatus in which the primary stream of one blender stage can serve as a secondary stream in the next blender stage, this being referred to as blender cascading.

56. To disclose a unique and novel continuous outflow stream liquids blending method and apparatus in which in an embodiment of the blender provided with a densitometer, such as a Coriolis mass flow meter, located on the discharge flow of the primary stream pump, the density of the primary stream liquid can be determined by first turning off flow from all secondary streams and then operating the primary stream pump until a volume of the primary stream liquid has been displaced which is greater than the known lumen volume as measured from a point just before the point of injection of the secondary stream furthest from the primary pump to the point defined by the output of the primary stream densitometer, and then reading the liquid density in the primary stream densitometer.

57. To disclose a unique and novel continuous outflow stream liquids blending method and apparatus in which the density of the primary stream liquid can be determined by first turning off flow from all secondary streams and then operating the primary stream pump until a volume of the primary stream liquid has been displaced which is greater than the known lumen volume as measured from a point just before the point of injection of the secondary stream furthest from the primary pump to the point defined by the output of the primary stream ratio dose sample valve, and then weighing a known volume ratio dose collected from the primary stream sample valve.

58. To disclose a unique and novel continuous outflow stream liquids blending method and apparatus in which the liquid supply feed to the primary stream ratio dose pump reservoir contains a suitable densitometer proximate to the reservoir, such that the density of the primary stream liquid flowing into the reservoir is known.

59. To disclose a unique and novel continuous outflow stream liquids blending method and apparatus in which a suitably sized densitometer, such as a Coriolis mass flow meter, is fitted between the outfeed port of the primary stream liquid supply reservoir before the stream injector assembly, such that all secondary stream points of injection are down-flow from the densitometer, thus allowing the density of the primary stream liquid flowing into the primary stream ratio dosing pump to be known.

59A. To disclose a unique and novel continuous outflow stream liquids blending method and apparatus in which a volumetric or mass liquid flow meter located between the outflow port of the primary stream liquid supply reservoir and the stream's injector assembly allows the volume or mass ratio dose of the primary stream liquid flowing into the primary stream ratio dosing pump to be known directly with each blender synchronous ratio dose cycle.

60. To disclose a unique and novel continuous outflow stream liquids blending method and apparatus in which the density of the blended streams can be directly measured by a suitable densitometer, such as a Coriolis mass flow meter, located in the discharge flow pathway of the primary stream pump, distal to all streams mixing elements or apparatus.

60A. To disclose a unique and novel continuous outflow stream liquids blending method and apparatus in which the volume or mass of the blended streams ratio doses can be directly measured by a suitable volumetric or mass liquid flow meter located in the discharge pathway of the primary stream servo-pump, distal to all streams mixing elements or apparatus.

61. To disclose a unique and novel continuous outflow stream liquids blending method and apparatus in which the density of a secondary flow stream liquid can be directly measured using a suitable densitometer, such as a Coriolis mass flow meter, located in the discharge flow pathway of the secondary stream pump.

61A. To disclose a unique and novel continuous outflow stream liquids blending method and apparatus in which the volume or mass of a secondary stream ratio dose can be directly measured by a suitable liquid flow meter located in the discharge flow pathway of the secondary stream servo-pump.

62. To disclose a unique and novel continuous outflow stream liquids blending method and apparatus in which the density of a secondary flow stream liquid can be measured by weighing a known volume ratio dose collected from the secondary stream sample valve.

62A. To disclose a unique and novel continuous outflow stream liquids blending method and apparatus in which the ratio dose volume or mass of a secondary flow stream liquid can be determined by measuring a sample ratio dose collected from the secondary stream sample valve.

63. To disclose a unique and novel continuous outflow stream liquids blending method and apparatus in which the densities of the primary stream liquid, the blended stream liquids, and the secondary streams liquids, as determined by any of the methods disclosed herein, can be utilized collectively to determine the ratio blending accuracy of the blender.

63A. To disclose a unique and novel continuous outflow stream liquids blending method and apparatus in which the ratio dose of the primary stream liquid, the ratio dose of the secondary streams liquids, and the combined ratio doses of the blended streams, as determined by any of the methods disclosed herein, can be utilized to determine the ratio blending accuracy of the blender invention.

64. To disclose a unique and novel continuous outflow stream liquids blending method and apparatus in which the density of the primary stream liquid can be determined by obtaining the density of the blended streams liquid and the density of each secondary stream liquid, and then multiplying the blended streams density by its blend ratio to get a density ratio total, then multiplying each secondary stream density by its blend ratio to get a density ratio for that stream, and then subtracting each secondary stream density ratio from the blended streams density ratio total, and then dividing the result by the primary liquid stream blend ratio.

65. To disclose a unique and novel continuous outflow stream liquids blending method and apparatus in which the size of the primary stream liquid ratio dose, expressed and measured as a weight or as a volume, can be computed and determined by sampling and measuring or by measuring the synchronous flow digital dose delivered, by the primary stream pump, and then sampling and measuring, or by measuring the ratio dose of each operating secondary stream, and then subtracting the weight or volume of each secondary stream digital dose from the primary stream digital dose weight or volume.

66. To disclose a unique and novel continuous outflow stream liquids blending method and apparatus in which the combined ratio doses flowing from the primary stream servo-pump can be established to be equivalent to the sum of all constituent ratio doses of the blend formula, as measured by weight or volume.

67. To disclose a unique and novel continuous outflow stream liquids blending method and apparatus in which the size of the primary stream liquid ratios dose, expressed as a volumetric dose or as a mass dose, can be computed and established by first determining the volumetric ratio doses or mass ratio doses as delivered through a liquid flow meter of suitable type located in the primary stream servo-pump discharge liquid flow pathway, and then by determining the volumetric ratio dose or the mass ratio dose of each secondary stream as delivered through a liquid flow meter of suitable type located in the discharge flow pathway of each secondary steam servo-pump, and then subtracting the ratio dose of each secondary stream from the primary stream ratio doses.

68. To disclose a unique and novel continuous outflow stream liquids blending method and apparatus in which the mass or volume ratio dose of the primary stream liquid, in a blender provided with a liquid flow meter in each stream, can be automatically computed and checked with each synchronous digital flow cycle of the blender.

69. To disclose a unique and novel continuous outflow stream liquids blending method and apparatus in which, in a blender of the present invention, where a Coriolis mass flow meter is located in the primary stream pump discharge and distal to a streams mixing apparatus, the Coriolis mass flow meter can define the total primary stream synchronous dose, and also measure, without the need for any additional apparatus, the completeness and efficacy of liquid streams blending and mixing by measuring the magnitude of density changes of the combined streams flowing through the Coriolis mass flow meter during synchronous digital flow.

70. To disclose a unique and novel continuous outflow stream liquids blending method and apparatus in which, in a blender provided with liquid flow meters or dosing pumps or other apparatus capable of detecting air or gas inclusions in a liquid stream, generally referred to as slug flow, such detection is used to immediately inhibit blender operation and to alarm the existence of such conditions, thereby preventing inaccurate ratio blending of constituent liquid streams.

71. To disclose a unique and novel continuous outflow stream liquids blending method and apparatus in which each liquid stream is provided with a positive displacement dosing pump controlled for flow rate and dose displacement.

72. To disclose a unique and novel continuous outflow stream liquids blending method and apparatus in which a stream positive displacement dosing pump may be a rotary pump, a piston pump, a peristaltic pump, or a diaphragm pump.

73. To disclose a unique and novel continuous outflow stream liquids blending method and apparatus in which the blender invention is prevented from operating whenever the volumetric or mass sum of the operating secondary streams ratios is equal to or greater than 100% of the blended liquids ratio formula, thus preventing the possibility of flow of secondary stream liquids into the primary stream liquid supply.

BRIEF DESCRIPTION OF THE FIGURES

FIGS. 10A through 10F are a series of somewhat diagrammatic views of preferred streams injector assemblies for use with the simplified continuous liquid stream blender.

DETAILED DESCRIPTION

Definitions

Figure 1:
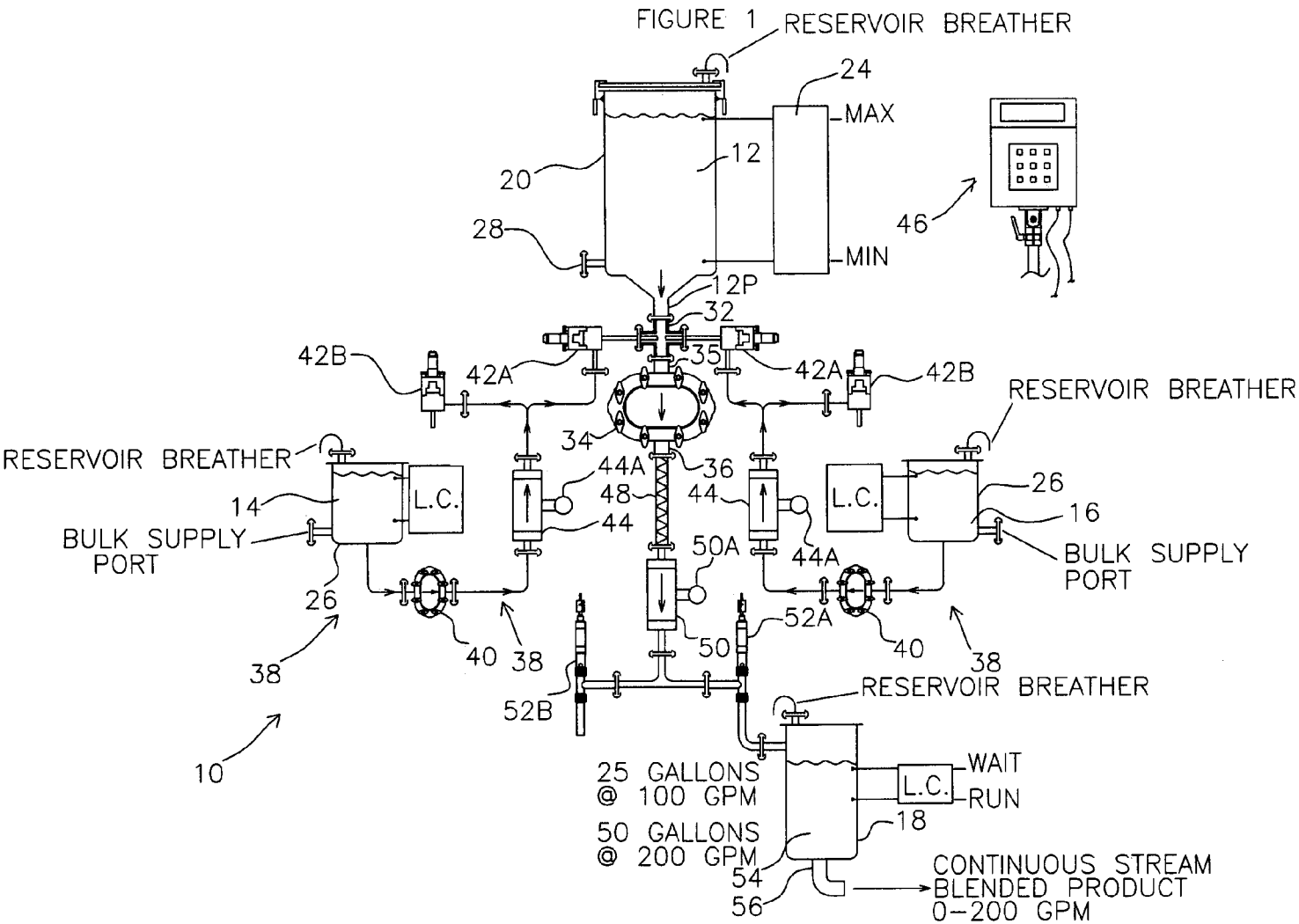
FIG. 1 is a diagrammatic view of a preferred embodiment of the simplified continuous liquid stream blender.

The following definitions are given for clarity of use, as these terms reappear frequently throughout this disclosure. For purposes herein, a flow stream can be defined as the constituent apparatus comprising one flow pathway of a liquid blender of the present invention. A blender must have at least two flow streams as a functional requirement. A flow stream typically consists of (first) a level controlled liquid supply reservoir or tank, and (second) a rotary positive displacement pump driven by (third) a motor, typically a servo motor, capable of controlling flow rate as a function of pump operation and of intermittent dosing flow operation synchronous with all other flow streams, and (fourth) optionally a liquid flow meter, and (fifth) a precision dose valve generally located at or near the point of liquids flow combining, and (sixth) optionally a duplicate precision dose valve for direct ratio dose collection. Many variations of constituent apparatus are possible and, thus, this definition is not intended to be limiting or restrictive by its examples. A flow stream can also be referred to as a stream, a channel, or a ratio dosing assembly or ratio dosing apparatus or a dose stream delivery assembly, while the dosing pump and servo motor combination may be referred to as a servo-pump.

For purposes herein, the primary liquid stream can be defined as the stream in which ratio dose outflow is 100 percent (by weight or volume) of the combined ratio dose flows of all blend stream liquid components comprising the blend formula, and in which one of the constituent blend liquids is directly supplied to the stream by a liquid supply reservoir, this liquid being referred to as the primary liquid.

For practical purposes of layout, cost, and construction of the fluid flow pathway of the apparatus invention, the primary stream is most typically the stream having a direct ratio fraction supply comprising the largest ratio portion of the blend formula, although this is not a functional requirement of the invention. The primary liquid stream can also be referred to herein as the primary stream, principle stream, base stream, or main stream.

For purposes herein, a secondary liquid stream can be defined as any liquid stream in which the ratio dose flowing through it is less than 100 percent of the total of all ratio dose flows of all functioning streams within the blending apparatus. A secondary stream can also be further defined as one where its flow terminates in or at the liquid supply of the primary stream pump, at the streams injector apparatus, which is located proximate to the suction port of the primary stream pump.

For practical purposes of layout, cost, and construction of the fluid flow pathway of the apparatus of invention, a secondary stream is most typically a stream having a ratio fraction which is not the largest ratio portion of the blend formula, although this is not a functional requirement of the invention. A secondary liquid stream can also be referred to herein as a secondary stream, a minor stream, an additive stream, or an ingredient stream.

For purposes of this specification, the streams injector assembly is defined as the liquid hydraulic flow structure where the primary liquid stream and the secondary liquid stream or streams come into fluid contact and initially flow synchronously together in ratio defined quantities. The streams injector assembly is located adjacent to the suction port of the primary flow stream pump. The streams injector assembly can also be referred to herein as the injector assembly, the injection assembly, the stream injector apparatus, the suction side injector, the constant pressure injector, or the low pressure injector assembly.

For purposes of this specification, the streams injector assembly can also include provision for the addition of solids into the combining liquid flow streams, and it can include one or more streams mixing elements within its flow lumen.

For purposes of this specification, liquids blending, or blending, is the overall process of combining two or more different liquids together in a defined ratio relationship, referred to herein as ratio combining or streams ratio combining, and streams mixing to achieve a combination of the liquid streams to some defined standard of homogeneous condition, also referred to simply as streams mixing or mixing.

General Description

By definition, a continuous stream blending system must make fully mixed liquid product available at its output at a makeup rate equal to takeaway demand. The takeaway demand rate is generally defined by the running speed of the liquid product packaging line being supported by the continuous stream blending system, or the consumption demands of the process or apparatus being serviced by the blender.

An intermittent motion on-off ("digital") multi-channel liquid product blending system which produces very small flow synchronized and completely blended batches of liquid product at a rate greater than a specified takeaway rate can function as a continuous stream blending system. The great virtue of this blender design methodology is that the high blend ratio accuracy of each stream component can be achieved on a pre-engineered basis which eliminates the sources of error and operating problems found in feedback loop designs. The final blended continuous stream flow can be turned on and off at will with no penalty in accuracy. The system volume is comparatively small and all finished product can be utilized at the end of a blend run. The output of the system can be directly and automatically varied to conform to the takeaway requirements, due to the on-off digital design. Also, due to the digital flow design, no cumulative errors in proportioning are possible beyond a single digital flow cycle.

Each digital (on-off) flow channel is typically comprised of an electronically controlled servo driven rotary pump/mass meter dosing technology as embodied by U.S. Pat. No. 5,996,650. These flow channels can be combined together and integrated with a PLC or other electronic control device and an Operator interface to form a continuous stream blending system. With this system architecture, each digital flow stream channel manages one of the liquid components to be blended into a finished product. Each stream turns on simultaneously and runs for a pre-defined dose time. Each channel's flow is digitally altered on a self-teach basis until the precise volume or mass ratio dose required is delivered in the defined run time, and each volume or mass flow ratio is checked with each flow cycle.

The time synchronized ratio dose (digital flow) from each liquid component channel is combined with the other channels in a particular and novel way, as detailed and illustrated within this specification.

In operation, each secondary or minor flow or additive flow channel is synchronously dosed into the central laminar flow area of the injector assembly which is located at the suction port of the primary flow stream servo-pump (see FIG. 1). Because the ratio flows of every stream in the blending system are time synchronized, the secondary flows are correctly ratio combined with the primary liquid component of flow as they enter the suction port of the primary liquid servo-pump. This unique and novel flow architecture confers critical operating advantages.

Most important, because each additive or minor stream flow channel terminates in an injector assembly at or near the suction port of the primary stream pump, the back pressure acting on the secondary flow servo-pump is essentially defined only by its own flow structure and the flow rate and rheology of the additive liquid. This is the case because the pressure within the injector assembly at the primary channel pump suction port is inherently low (typically at or near atmosphere) and varies little as a function of flow through the primary stream servo-pump. The back pressure acting on each additive stream is therefore definable and predictable unto itself. The critical concept here is that, regardless of the back pressure acting on the discharge of the primary flow channel pump, this pressure is decoupled or isolated or divorced such that the discharge pressure acting on any secondary streams pump is not altered or affected.

With constant and defined back pressure, the displacement of each secondary stream servo-pump per increment of rotation is highly understood, defined, and stable, allowing high repeatability and stability of each synchronized flow ratio dose.

Said another way, with the unique and novel flow arrangement disclosed herein, the back pressure on the discharge of the primary flow channel has no influence on the back pressure of the additive flow pathways, and thus cannot alter the flow rate of the additive fluid flow pathways. Therefore; there is no cross talk or interaction between the ratio flow streams. This elimination of the interactivity of ratio dose or flow between blending channels, using the simplified flow structure of this invention, plays the most essential role in assuring straightforward control and operation of the blending system, free of "glitches" or "quirks".

Another important advantage of the simplified blender architecture is that, because the ratio dose from each channel is not influenced by any of the other blender channels, each can be calibrated discreetly and separately. Therefore, the set-up values and volumetric or mass ratio dose defined and empirically tested separately for each channel remain valid in full dynamic system operation with all channels flowing together synchronously.

The unique and novel architecture of this invention also allows direct system performance measurement and validation. Because the discharge pressure of each flow stream is defined only by its structure and the liquid flow rate and rheology, direct ratio sampling of each flow channel in the system is possible and practical as a means of empirical verification and validation of correct blend ratio performance. In practice, each flow channel is provided with a second automatic fast-acting positive shut-off dosing valve identical to the unit used in the injector assembly. The second automatic dosing valve in each stream can be selected to allow direct ratio dose collection for volumetric or weight measurement. The collected fraction reflects dynamic operation since the back pressure at delivery is essentially the same as that in the fully operating system. This procedure also allows direct ratio dose calibration of each stream flowmeter, if discrete flowmeters are utilized.

Another operating advantage of the present invention flow architecture is that the secondary or additive flow fractions pass first through the primary flow stream pump before entering a streams mixing assembly in the primary pump discharge flow pathway. As a result, the primary flow pump can serve as a pre-mix device, contributing to thorough streams mixing.

Another valuable attribute of the simplified design is found in component service life. Because the novel architecture allows comparatively low pressure system operation of the minor streams dosing channels, secondary stream dosing pump service life is greatly extended, often by as much as an order of magnitude.

Standardization of flow components is also an attribute of this simplified blending system. In the new simplified design, each flow stream is operated in an on-off or digital format. Each stream dose is produced by a highly proven three or four element module that has been pre-engineered. For volumetric blending operation, each stream dose is produced by a motor drive, typically operating as a servo, a positive displacement (PD) pump, typically a rotary type, and a designed to purpose fast-acting positive shut-off dose valve. For mass ratio operation, a fourth element is added, a Coriolis mass flow meter. A volumetric type flow meter can also be used for volumetric mode operation, if desired.

Referring again to FIGS. 1 and 2, in typical operation, the various minor stream liquid components comprising a product formula are servo-pump dosed through mass meters and precision dose valves into the injector assembly located at the suction line or suction port of a primary stream flow channel servo pump. The primary flow stream generally consists of the largest ratio liquid component and typically constitutes most of the finished product by mass or volume. Each minor or secondary stream dose is flow synchronized to the other minor component streams and also to the primary flow channel stream, so flows of all streams start simultaneously and end simultaneously. With this flow layout, the correct dose fraction of each liquid component is guaranteed to enter the suction or infeed port of the primary stream servo-pump with each blender system cycle. The primary flow channel pump produces a flow dose set to 100% of the combined streams volumetric or mass dose as called for by the product formula. Thus, all of the product constituent streams enter the primary flow channel pump synchronously and in correct ratio and are pumped out at exactly the same rate and ratios. Thus, flow through the entire system into the finished product tank 18 is synchronous.

The use of suction side injection of the minor streams into an injector apparatus at the in-flow port of the primary stream pump plays a critical role in assuring straightforward operation of the blender system, free of "glitches" or "quirks". This is because suction side injection guarantees that the back pressure imposed on each dose stream by the streams combining structure is very low and, above all, nearly invariant. This novel arrangement allows the combining chamber and the discrete and separate mix stage pump of earlier art to be eliminated, simplifying the blender and eliminating an entire operating stage.

Because the back pressure acting on each dose stream at the combining or blending point (the injector assembly located at the suction port of the main stream pump) is low and stable (by design), the auto tune electronic control system quickly achieves the correct stream dose in the correct time (flow synchronization) and easily holds synchronization from blending system cycle to cycle with only small rational trim corrections required.

Looked at from the viewpoint of each minor stream dose channel, the inventive use of a low or constant pressure injector assembly located at the suction feed to the primary stream pump assures that the back pressure on each minor dose stream is defined by the system components used in that channel and not by any other blending system element. Thus, there is essentially no interaction affecting the ratio dose from one channel by any other channel.

Because the dose from each channel is not influenced by the others in the system, each channel can be calibrated discretely and separately. Therefore, the setup values and volumetric or mass dose remain valid in full dynamic system operation with all channels operating.

The use in this invention of suction side streams combining essentially decouples and separates the crucial mass or volume ratio dosing function from the equally crucial streams mixing function. Both functions must be effectively achieved in a successful continuous stream blending system. With this simplified continuous stream blending system architecture, the often conflicting engineering requirements of synchronized dosing and mixing of the product can be separately accommodated without compromise because the sizing of the primary stream pump to accommodate the discharge back pressures associated with mixing structure and flow has no bearing on the engineering requirements of the minor streams components.

With the unique and novel design of the simplified blender invention, the high back pressures typically encountered in commonly used static and ribbon mixers are readily accommodated by the use of a suitably sized primary stream pump and servo drive without any concern for the effect this could have on the minor streams. With the new design there is no back pressure interaction between blending stream dosing and blending stream mixing.

The simplified blender design of this disclosure can be referred to as "N+1 design" where N represents the number of minor dose stream servo pumps required and the "plus one" represents the servo controlled primary stream pump.

In operation, the combined flow rates produced by the new simplified system are greater than a planned maximum takeaway rate. Typically, the combined maximum digital flow rate is established to be about 30% faster in unit time than the maximum required final blend tank continuous outflow takeaway rate.

The elevated infeed flow rates of each formula component allows short (typically five seconds) synchronized runs of each volumetric or mass liquid stream channel, followed by a no-flow time of about one second. This arrangement allows the simplified system to keep up with takeaway demand while operating in the digital flow on-off format. During the off period, each channel's mass or volume delivery and synchronization are checked and adjusted as necessary. A last in-first out (LIFO) averaging method is used. Each channel is electronically set to dose its correct volume or mass dose in the defined run time by adjusting the flow rate of the servo-pump. The dose constitutes the precisely correct volume or mass ratio required by the product formula. With this method, long term and cumulative ratio errors are not possible, and system performance is assured.

Figure 11:
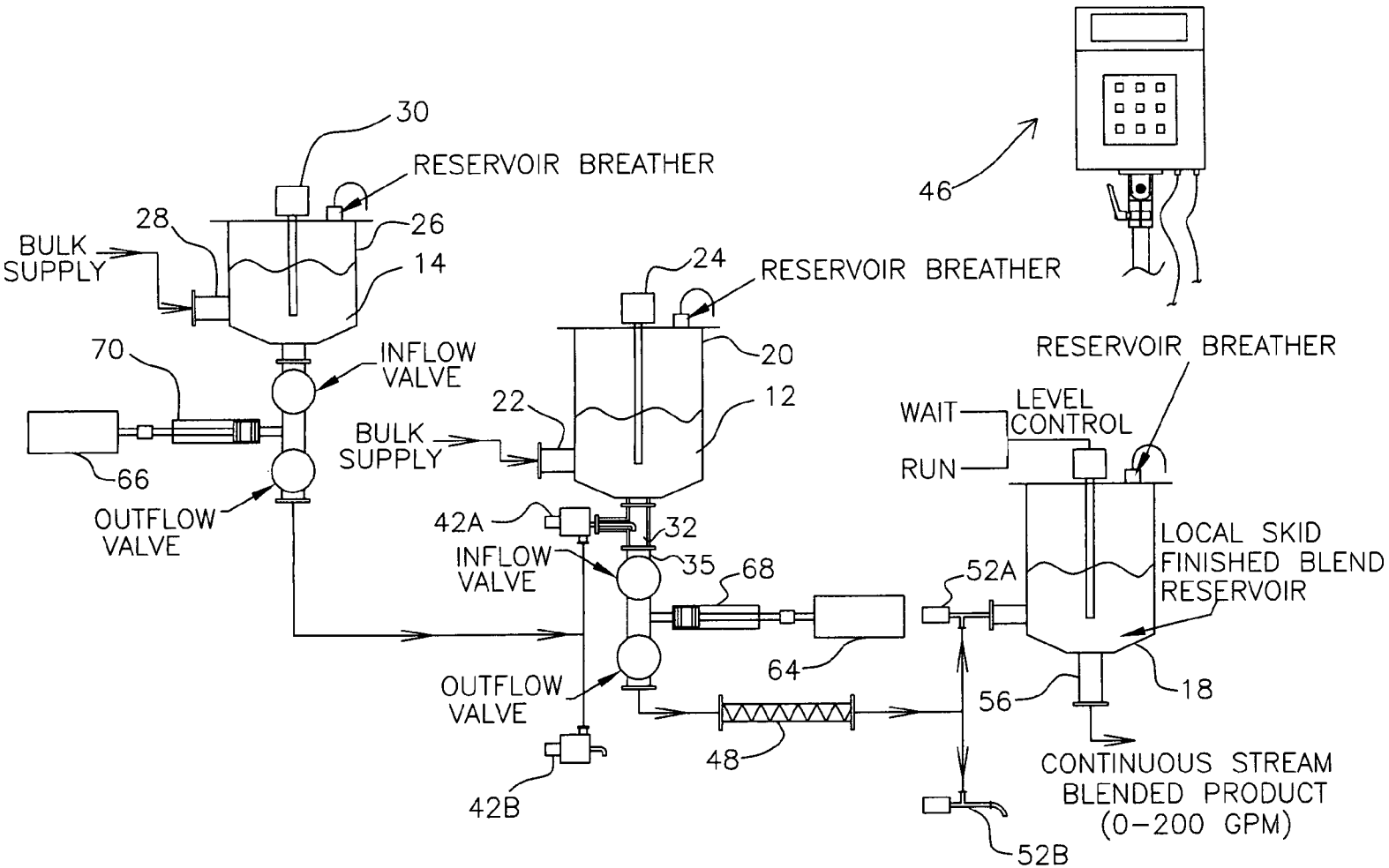
FIG. 11 is a diagrammatic view of an embodiment of the simplified continuous liquid stream blender showing the use of piston pumps for blender operation.
Figure 12:
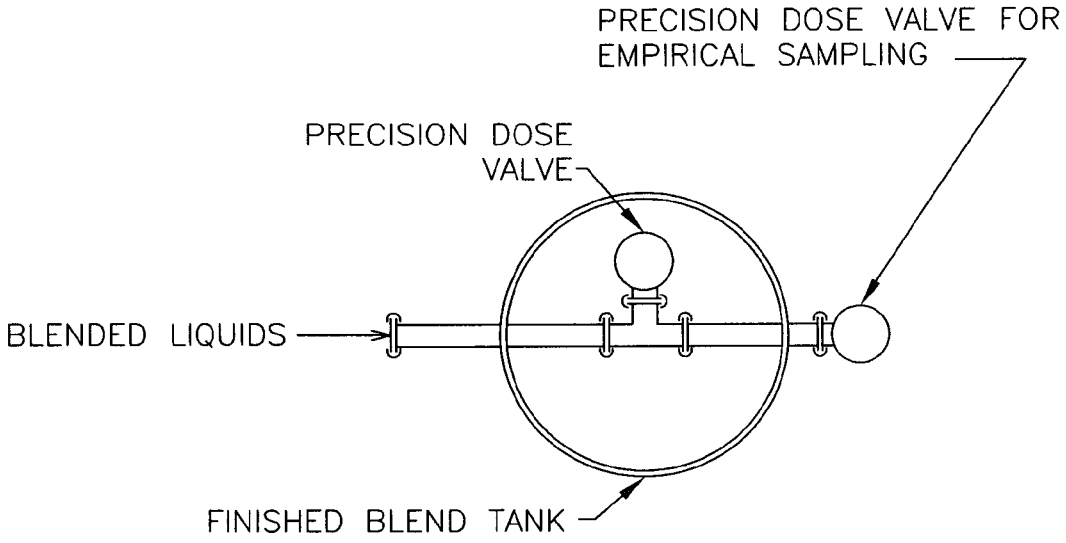
FIG. 12 is a diagrammatic top view of the finished blend thank of the simplified continuous liquid stream blender showing the finished blend sample valve being located distal to the finished blend dose valve.

Referring to FIG. 11 of the specification, a piston pump based embodiment of the simplified blender architecture is illustrated. In the case where reciprocating pumps, such as piston pumps or diaphragm pumps, are utilized the operating sequence of the blender is modified to accommodate the unique liquid priming and displacement cycle of these pump types.

A reciprocating pump operates through a first suction stroke and then a second discharge stroke. Thus, when these pump types are used in the present invention, the secondary stream pumps execute a discharge stroke simultaneous with the primary pump executing a suction stroke. This allows the secondary stream ratio dose to be displaced at low and stable and non-interactive back pressure into the streams injection chamber in a manner essentially identical in hydraulic characteristics and physics to that found in embodiments of the simplified blender invention where rotary positive displacement pumps are used.

After the synchronous dose of the primary and secondary streams are completed as described, a complete digital flow ratio dose of the combined liquids is present in the primary stream piston pump. Thus, as a next sequence event, the primary stream pump executes a discharge stroke and the combined liquids streams are displaced through the mixing elements or device and on into the finished blend tank. While the primary stream piston pump is completing its discharge stroke, the secondary streams piston pumps are typically completing a suction stroke in order to be ready for the next ratio flow cycle. As with the other embodiments of the invention, volumetric or mass flow meters can be utilized in this embodiment of the invention as well. By the nature of reciprocating pumps, when the invention utilizes these pump types, it is sometimes possible to eliminate the relatively local liquid supply tanks generally used with rotary pumps in the present invention, in favor of a piped supply from a remote source.

With the piston pump embodiment of the blender invention, the stroke of each pump, and thus its ratio dose, can be adjusted electronically, or electromechanically by moving a piston stroke stop using an actuator, or by completely mechanical means by moving a piston stroke stop manually, with or without a dial or vernier position indicator. The primary stream piston pump can also be completely free of any volumetric adjustment, its known fixed displacement at full stroke constituting one complete volume per stroke of all ratio defined streams.

As each stream component is dosed into the streams injector assembly and then combined by the primary stream pump and blended with the other streams by the mixer element, the blended streams are displaced into a small finished product tank which typically then feeds a liquid filler on a continuous stream demand basis or provides supply to another process or use. A fixed "cycle time", typically one second, is imposed at the end of each aliquot batch, after which another digital batch can be produced if demanded. Electronic level controls in the small final blend tank can provide for fully automatic start-up to charge the fluid flow pathway. These level controls also automatically control the overall flow pattern in the system. A "wait" level control allows for sufficient final blend tank capacity to assure completion of any aliquot batch in progress. A "run" level control causes digital batching to begin whenever tank level falls below the run sense point. The wait-run differential is generally tightly set, typically to a small fraction of final blend tank capacity. In practical terms this holds tank level quite tightly about the run sensor level, since this is really the "trip" which initiates digital blending, and when the system is running, product is being made at a rate faster than takeaway. A separate pair of high alarm and low alarm sensors can guard against any possible outfeed malfunction. In effect, this small final blend tank is little more than a "bulge in the line" and adds very little to the total volume of the system. All of the product entering this tank is finished product and can be packaged or utilized. This control scheme, where the filler or end use demand drives sequentially back through blender functions, can be referred to as "ripple back" design.

In the event that a stop command is received by the blending system when the final blend tank is just below the max level and a digital blending cycle has just started, the synchronized dose run must be completed to assure that blend accuracy is maintained. Thus, a "surge" capacity equivalent to one digital blending cycle is built into the design. By way of example, in a 200 GPM continuous outflow system of the present invention, one digital blending cycle is no more than 25 US gallons in volume, while in a 100 GPM system it does not exceed 12.5 US gallons. Thus, with this small buffer or surge volume, the system can be started and stopped and restarted at any time without the possibility of introducing proportioning error because any dose in process can be completed, without compromise, regardless of system status.

Another major advantage of this novel simplified continuous stream blending architecture is that adequate tank volume provision can be made to insure the availability of sufficient blended product to complete all fills in progress on a filling line, even with a forced shutdown of the feed streams. This assures an orderly packaging line shutdown without the possibility of partial fills. It is also important to note that any product reaching the filler must be, by definition, correctly blended.

The fact that with streams combining on the suction side of the primary stream pump, each channel can be software calibrated on a self-teach and self-correcting basis to synchronize dose flow on a non-interacting basis with the other stream dose components means that the major source of system error, flow rate adjustments for changing rheologies, changing ratio shifts, or changing takeaway rates, is totally eliminated.

This unique and novel blender invention also substantially simplifies the software and setup computations required of the system. The broad dynamic range of each flow channel ratio dose size (up to 100:1) insures that a system design can be successfully utilized across a broad range of product formulas without the need for extensive re-configurations. Large differences in viscosities and other stream flow characteristics can often be accommodated from one product formulation to the next.

In summary, this invented system architecture for a simplified continuous stream digital blending system is extremely simple, logical, easy to program, low in system volume, easier to clean than previous designs, and completely free of error induced by process variables or system interactions. It can be stopped and started without penalty and all blended product can be utilized. It is a system which is inherently accurate rather than one requiring complex control schemes to "tame". Systems are practical with feed rates ranging from a fraction of a gallon per minute to well over 200 gallons per minute.

As a means of further explanation, consider the following operating example:

Configure a system to provide a continuous flow of liquid product to a filling line at the maximum rate of 100 GPM.

Note that the math procedures described below are actually performed by the control system, typically a high end PLC combined with a PC based color graphic touch screen operator interface. Also note that this example will utilize mass flow as the streams ratio defining method. It is important to note that the present architecture can also function accurately and reliably on a volumetric basis using the servo-pumps only, without Coriolis mass flow meters.

| | Component | Formula Volume (Gal.) | Component Specific Gravity |
|---|---|---|---|
| 1. | Water | 56.95 | 1.00 |
| 2. | Flavor A | 6.25 | 0.91 |
| 3. | Flavor B | 9.20 | 0.97 |
| 4. | Color A | 0.88 | 1.12 |
| 5. | Color B | 1.05 | 1.04 |
| 6. | Liquid Sweetener | 18.75 | 1.21 |
| | TOTAL | 100.0 | |

Step 1

Convert the volumetric formula to metric units to allow ease of subsequent calculations. Thus: The volumetric formula, as given, is in gallons. This must be converted to liters. Each gallon contains 3.785 liters. Therefore:

| | Component | GPM | LPM |
|---|---|---|---|
| 1. | Water | 56.95 | 215.55 |
| 2. | Flavor A | 6.25 | 23.656 |
| 3. | Flavor B | 9.20 | 34.822 |
| 4. | Color A | 0.88 | 3.331 |
| 5. | Color B | 1.05 | 3.974 |
| 6. | Liquid Sweetener | 18.75 | 70.970 |
| 7. | Preservative | 6.92 | 26.192 |

Note that the flow rate of each formula component is still expressed in volumetric units per minute.

Step 2

Convert the metric-volumetric formula to a metric-mass formula.

To convert the volumetric formula to mass, simply multiply each component volume by its specific gravity. The result is expressed in kilograms per minute of flow (KPM). Thus:

| | Component | LPM | Specific Gravity | KPM |
|---|---|---|---|---|
| 1. | Water | 215.556 | 1.00 | 215.556 |
| 2. | Flavor A | 23.656 | 0.91 | 21.527 |
| 3. | Flavor B | 34.822 | 0.97 | 33.777 |
| 4. | Color A | 3.331 | 1.12 | 3.731 |
| 5. | Color B | 3.974 | 1.04 | 4.133 |
| 6. | Liquid Sweetener | 70.970 | 1.21 | 85.874 |
| 7. | Preservative | 26.192 | 0.89 | 23.311 |

Note that the flow rate of each formula component is now expressed in mass units per minute.

Step 3

Re-state the mass based formula in terms of required flow rates, adjusted upward to accommodate the digital on-off cycling of the system.

In this example, aliquot dose flow rates will be increased to 30% above takeaway rates. The additional flow factor provides a generous allowance for numerous system function actuation times including a one second cycle time between successive digital cycles. This means that the mass flow rate of each formula component is increased by the necessary increment to insure that the final 100 GPM continuous stream blended flow is available, with the one second off time accounted for. In this example, each mass flow rate is multiplied by 1.30 to effect the necessary increase in flow in unit time. Thus:

| | Component | Base KPM | Time Adjusted KPM |
|---|---|---|---|
| 1. | Water | 215.556 | 280.223 |
| 2. | Flavor A | 21.527 | 27.985 |
| 3. | Flavor B | 33.777 | 43.910 |
| 4. | Color A | 3.731 | 4.850 |
| 5. | Color B | 4.133 | 5.373 |
| 6. | Liquid Sweetener | 85.874 | 111.636 |
| 7. | Preservative | 23.311 | 30.330 |

Step 4

Adjust the mass flow rate of each dose channel to deliver the correct aliquot batch mass dose in a 5.0 second run time.

This is done to limit the aliquot dose size. Remember that continuous stream blended flow is achieved by repetitive processing of small subtotal (aliquot) doses. Extensive experiments with mass meters have shown that a minimum "on" or run time is needed to achieve optimal accuracy and repeatability. A five second "on" period is near the minimum run time allowable for best accuracy results. It is crucial to understand that the shortest practical run time self-limits any possible blend ratio error since each channel is analyzed and self-corrected between each flow interval. Thus, the shorter the run time, the more frequent the checks, and the more accurate the results.

The batch component mass flows per minute have been previously derived as kilograms per minute in Step 3. To re-express these flows, in ratio, for a five second flow period requires only that they be divided by twelve. Thus:

| Component | 5 Second |
|---|---|
| Water | 23.352 |
| Flavor A | 2.332 |
| Flavor B | 3.659 |
| Color A | 0.404 |
| Color B | 0.448 |
| Liquid Sweetener | 9.303 |
| Preservative | 2.528 |

The system cycle mass total is 42.026 kilos. This is a single cycle of approximately 11.10 gallons.

Step 5

After the five second mass dose aliquots are defined, each servo driven stream pump and Coriolis mass meter unit is electronically trimmed to simultaneously deliver its precise mass dose in exactly five seconds. The procedure can be manual or completed on an auto-tune or self-teach basis and is generally described as follows:

5.1. Each flow channel servo-pump flow rate can be linearly adjusted in increments of at least one point in 999 by digital electronic interface between the system computer and the servo drive.

5.2. A highly stable quartz crystal precision millisecond clock (1000 Hz) is provided to the PLC (this cannot be internally generated to suitable accuracy). This clock allows the PLC to define a precise synchronous dose channel run time of 5000 milliseconds (five seconds) without error.

5.3. Each mass meter generates a pulse train which is directly linear in frequency to mass flow. Thus, each pulse defines a known increment of mass flow. This frequency is generally at 10,000 Hz at maximum channel flow and is, thus, capable of very high resolution.

5.4. Because each ratio dose channel was sized to fit its required flow specifications, it is assured that each servo-pump can be adjusted in mass flow rate to deliver the required mass dose in 5000 mS.

5.5. In practice, each servo-pump is set at correct flow and the mass dose is "counted". The actual mass dose delivered in the 500 mS synchronous run time is compared to the required mass dose, using the direct sample ratio dose valves or the flowmeter readout or calibrated pulse count. Thus system start-up is at or very near specification without lengthy trial and error test cycles. Automatic corrections (increased flow or decreased flow) are then made to the servo-pump flow rate until the correct mass dose is delivered in exactly 5000 ms. The result is a precise mass flow dose ratio on each channel, with all streams precisely flow synchronized together. A direct dose sample capability is provided for each blending system channel to allow easy verification of dose using an independently validated scale, at any time during blender operation.

5.6. After the system is placed into operation, the same check of mass flow vs. time is made on every flow stream on every system cycle, thus assuring continuing precision flow rate accuracy and synchronization without the possibility of accumulated error. It is important to understand that this comparison and correction process is to insure time matched flow ratios in order to insure precision ratio blending. Note that the correct mass dose can be delivered on an aliquot dose cycle, regardless of channel flow rate, or ratio flows can be terminated at the end of the digital flow time, even if the correct ratio dose has not been delivered. In either case, flow rate correction occurs during the no flow period between dose cycles.

5.7. Extensive computational checks of the batch formula are made to eliminate any possibility of mathematical error.

5.8. Each dose channel is designed with extensive real time diagnostics. Any malfunction can be digitally transmitted to the PC based graphical color touch screen and displayed in full message text, as well as graphically.

5.9. At least three layers or levels of independent and discrete performance verification can be provided. This level of redundancy allows the blender invention to be used in even the most mission critical blending environments.

DESCRIPTION WITH REFERENCE TO THE DRAWINGS

In order to fully disclose all aspects and elements of the invention of this specification, its workings and operation will now be discussed in detail with reference to the accompanying drawings of the invention and its various embodiments.

Figure 2:
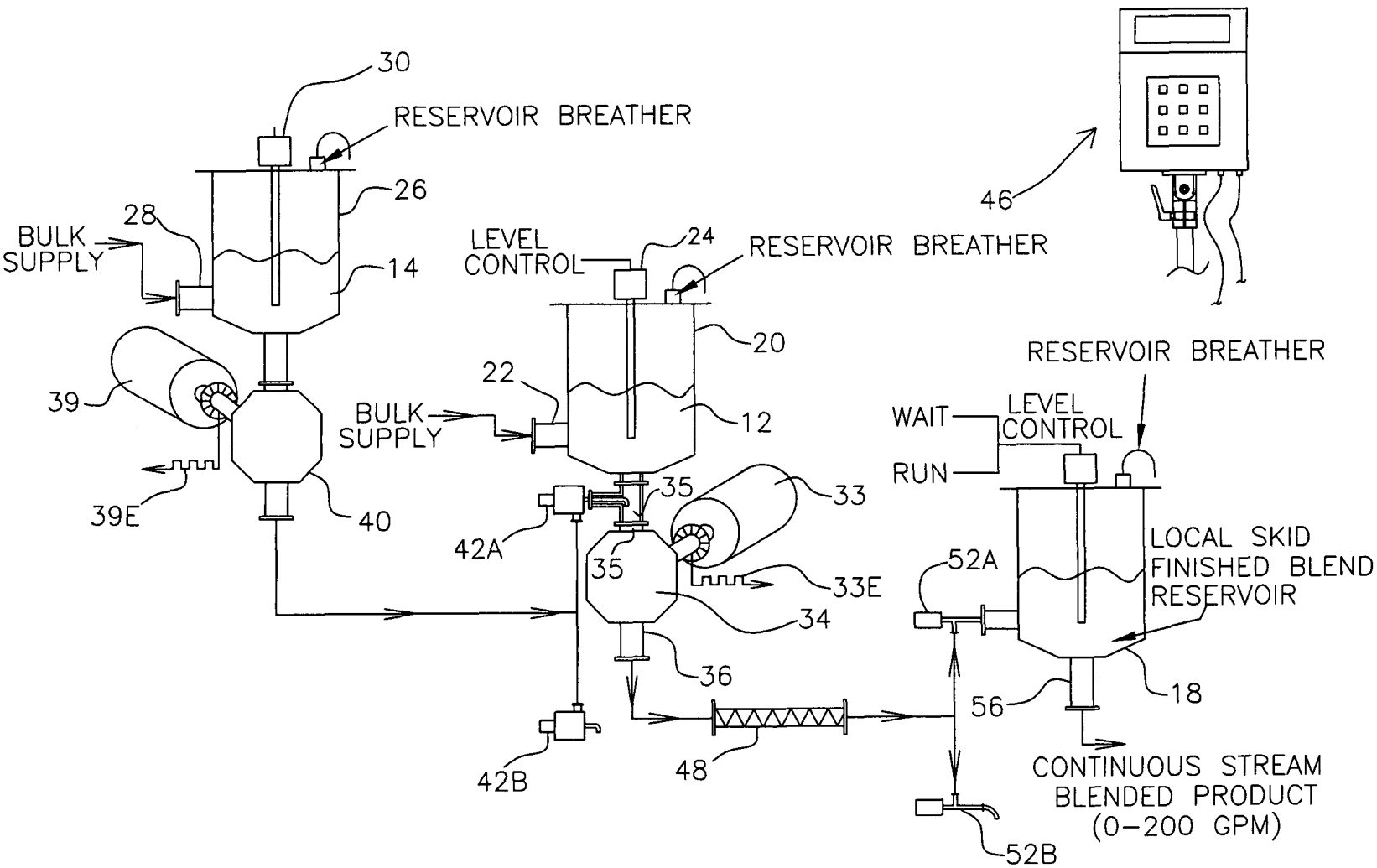
FIG. 2 is a diagrammatic view of the simplified continuous liquid stream blender showing a volumetric embodiment of the invention.
Figure 3:
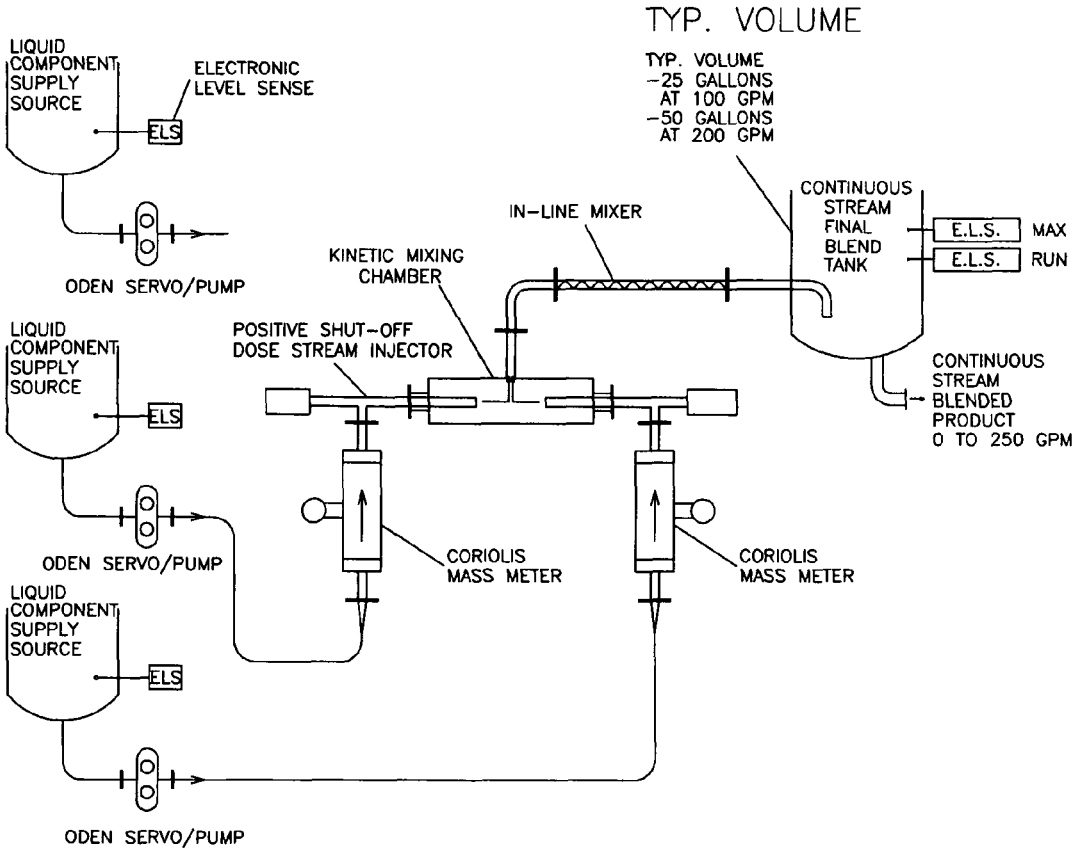
FIGURE 3 PRIOR ART
FIG. 3 is a diagrammatic view of known prior art from U.S. Pat. No. 6,186,193 B1.
Figure 4:
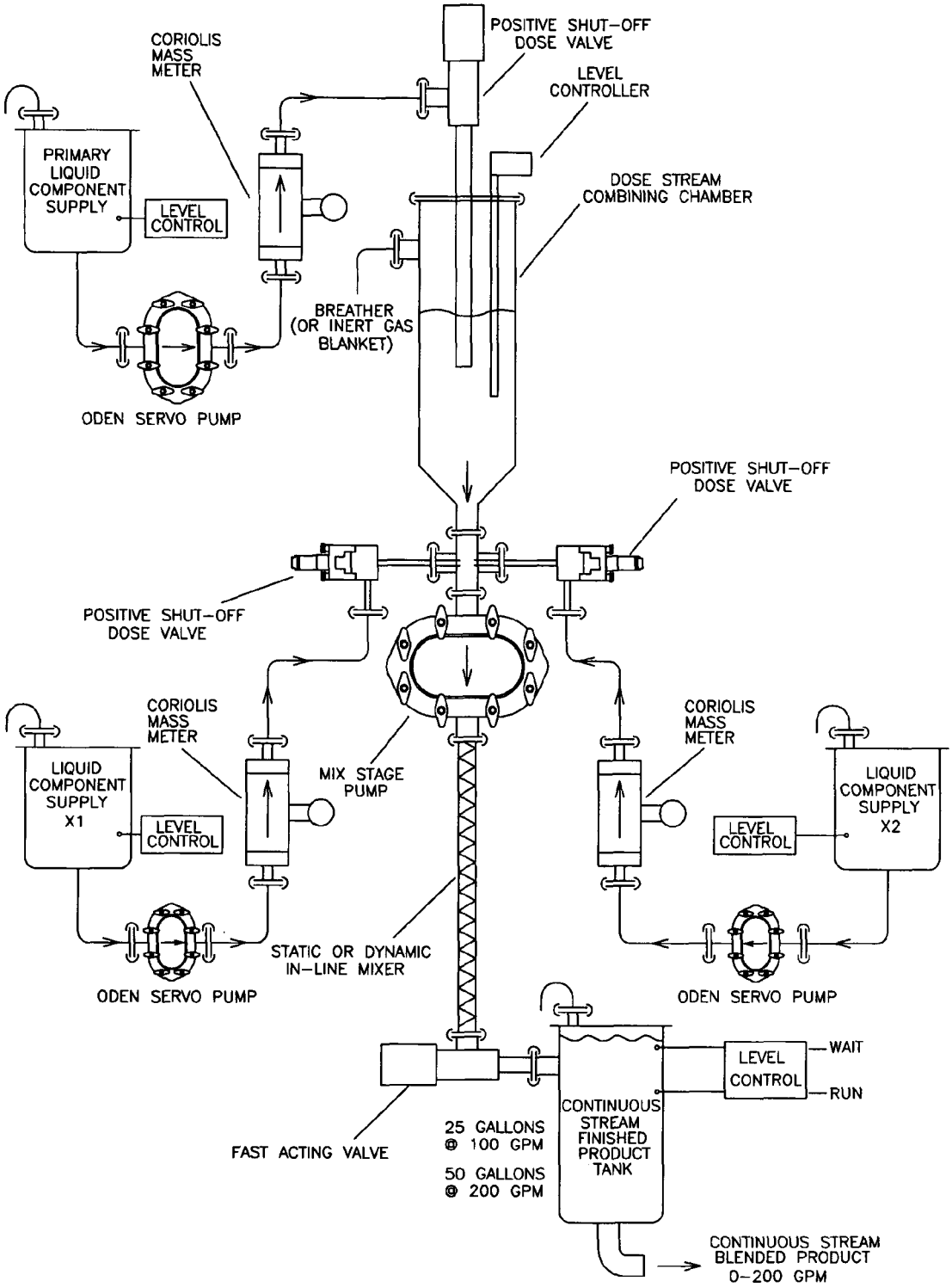
FIGURE 4 PRIOR ART
FIG. 4 is a diagrammatic view of known prior art from pending application U.S. Ser. No. 11/125,807.

The operation of the continuous liquid stream blending apparatus of this invention, which is indicated generally at 10, can be appreciated from FIG. 1. The apparatus is used to blend a primary liquid supply 12 with one or more secondary liquid supplies, two being indicated in FIG. 1 at 14 and 16, the combined fluids to be mixed and delivered to a finish blend product tank 18. The primary fluid 12 is initially contained in a primary liquid reservoir or supply tank 20 which in turn receives it from a bulk supply through a port 22 as can be seen from FIG. 2. The level of the primary supply 12 is maintained in the tank 20 via a level control 24, as it beneficial that the hydraulic pressure of the primary supply remains relatively constant. The secondary liquids 14 and 16 are initially contained in a secondary liquid reservoir or supply tanks 26 which in turn receives the secondary liquid supplies from bulk supplies through ports 28 as can be seen from FIG. 2 where only a single secondary liquid supply tank 26 is illustrated. While only one tank 26 is illustrated in FIG. 2 and while two secondary liquid supply tanks 26 are illustrated in FIG. 1, other numbers of tanks may be employed, and most typically each stream has a liquid supply tank. The level of the secondary liquid supply in each secondary tank 26 is maintained via a level control 30. A streams injector assembly 32 (or streams injection assembly 32) is provided, which assembly 32 is in constant fluid communication with the primary liquid supply 12. Primary liquid is caused to flow into the streams injector assembly 32 due to the suction of the primary stream ratio dosing servo-pump 34 which is disposed below the primary liquid supply tank, the pump being in fluid communication with the primary liquid. It should be obvious from an inspection of FIG. 1, that when the primary pump is caused to be operated, its suction will cause fluid to be withdrawn from the supply tank 20, to enter into the streams injector assembly 32, to enter the primary stream ratio dosing pump 34 through the suction side or infeed port 35 and to then exit from the discharge or outlet port 36 of the pump.

Figure 14:
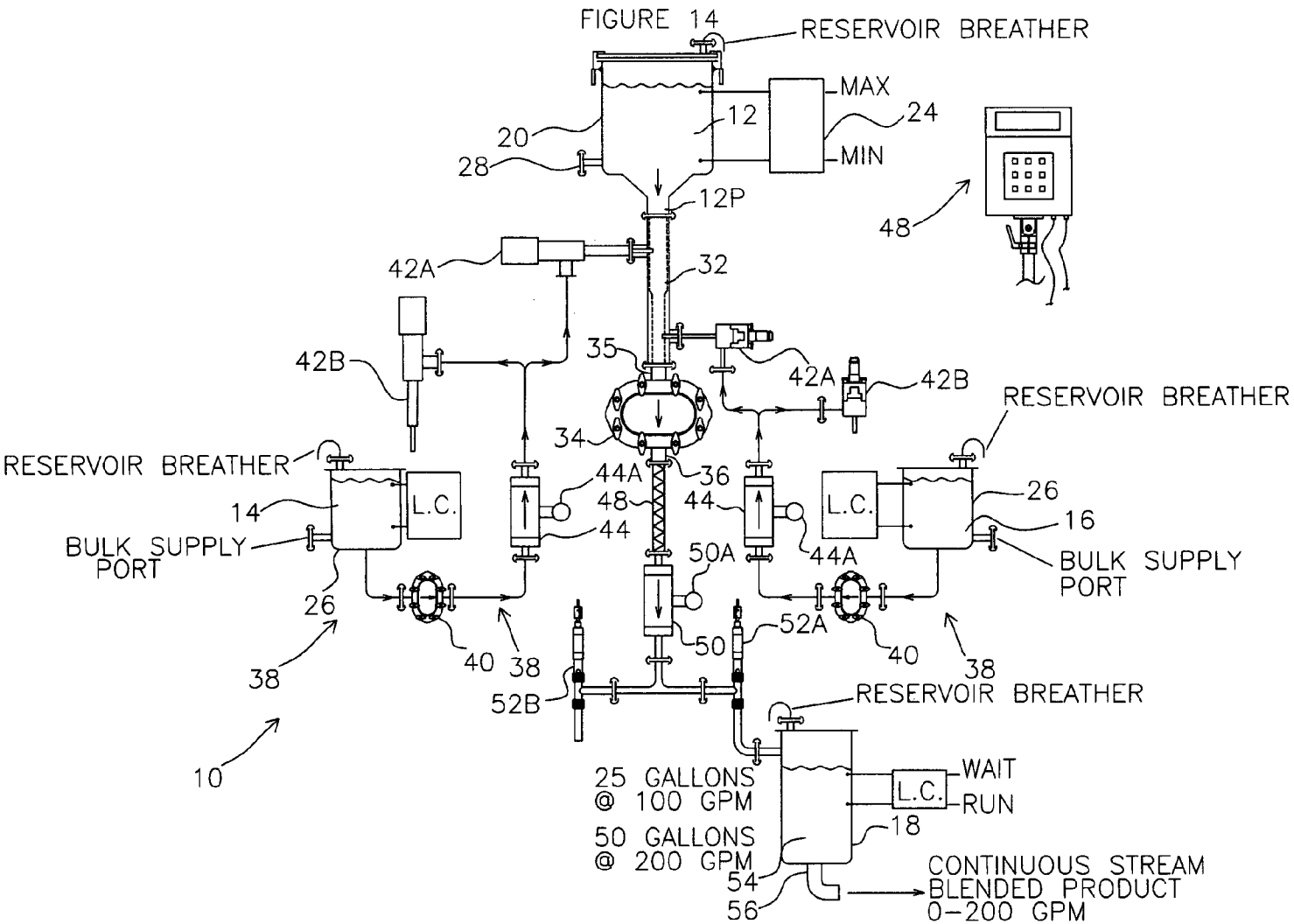
FIG. 14 is a diagrammatic view of the simplified continuous liquid stream blender showing stepped reduction in diameter of the streams injector assembly.

The streams injector assembly 32 also receives secondary fluids 14, 16 which flow simultaneously with primary fluid 12. To this end, dose stream delivery assemblies, indicated generally at 38, are located downstream of the one or more secondary liquid supply tanks 26. Each of the dose stream delivery assemblies or minor stream dose channels 38 include secondary liquid ratio dosing pump 40 or secondary stream servo-pumps 40 and a precision shut-off valve 42 which may be of the type shown in FIGS. 14a and 14b of U.S. application Ser. No. 11/125,807, the subject matter of which is incorporated herein by reference thereto. Each of the dose delivery assemblies may include a flow meter 44 of the volume flow or mass flow type.

The primary stream and secondary stream servo-pumps are caused to operate synchronously by control means 46 which is operable to simultaneously start and stop flow through each ratio dose delivery system channel. With each simultaneous starting and stopping operation of the primary and secondary servo-pumps, repeated synchronized doses are delivered to the final blend tank 18. The control means is also operably interconnected to the flow meters, if used, and to the positive shut-off dosing valves 42. The primary and secondary fluids are mixed somewhat by the primary servo-pump 34, and, after discharge through port 36, are further mixed by flowing through a static or dynamic in-line mixer 48. The mixed fluids may pass through a further flow meter 50, and will continue on to another precision dose valve 52*a*, also under the control of the control means 46. The blended fluids will then be delivered to the finished product tank 18. Blended fluids 54 will be discharged from the tank via outlet port 56 on a demand basis. As can best be seen from FIG. 15, the tank 18 is also provided with level sensors in communication with the control means. One level sensor, the run sensor 58, will initiate a signal to the control means that additional blended product is needed in the tank 54 when the blended fluid falls below a certain level. The other level sensor, the wait sensor 60, will send a signal to the control means to the effect that no more blended product is required in the tank 54 when the blended fluid is above a certain level.

Figure 15:
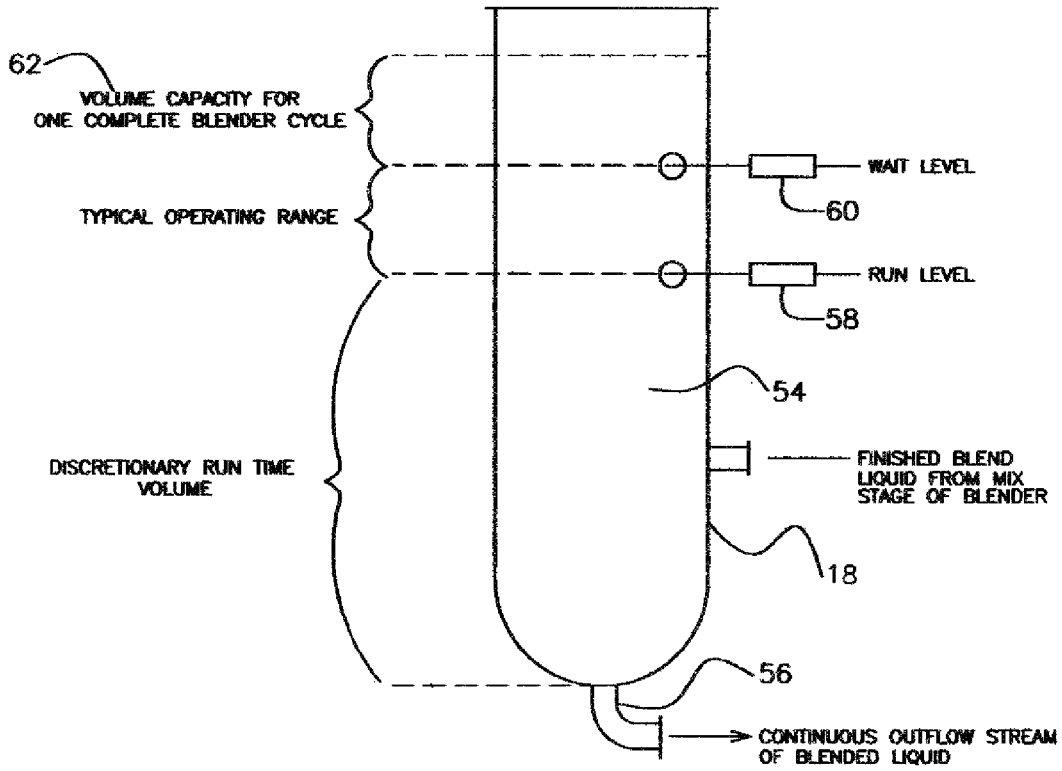
FIG. 15 is a diagrammatic side view of the finished blend tank of the simplified continuous liquid stream blender invention.
Figure 16A:
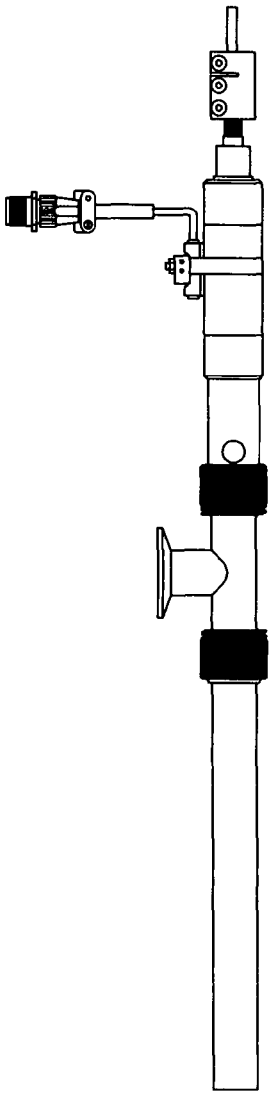
FIGURE 16A PRIOR ART
FIGS. 16A and 16B are assembled and exploded views of a positive shut-off liquid filling and dosing nozzle-valve as an example of known prior art.
Figure 16B:
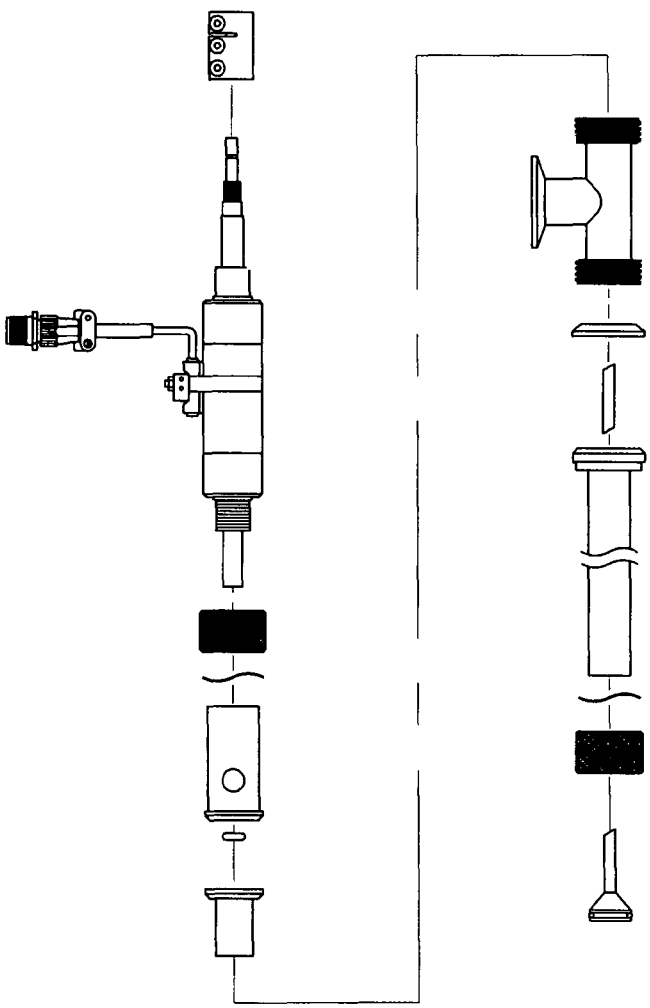
FIGURE 16B PRIOR ART
Figure 17:
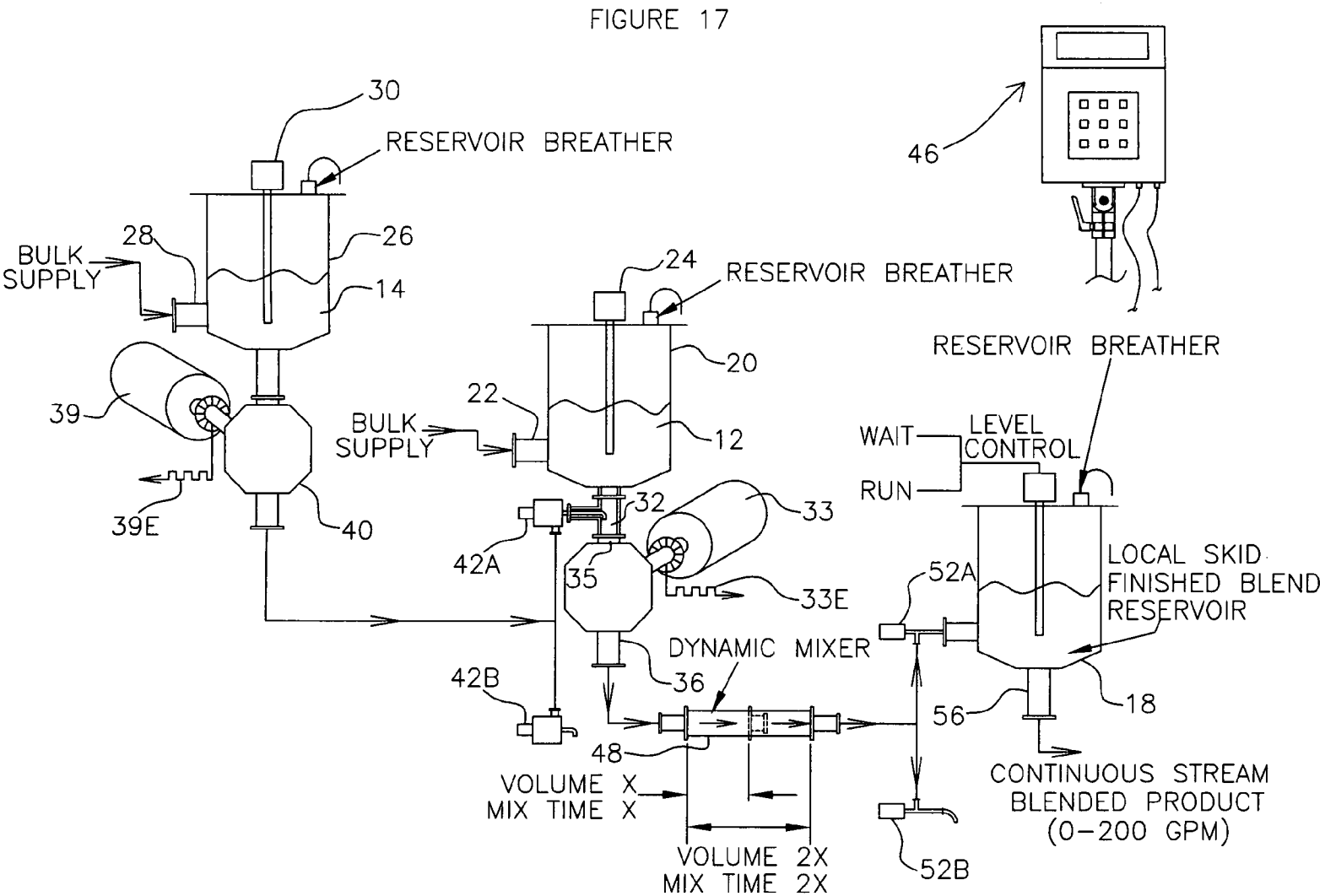
FIG. 17 is a diagrammatic view of the simplified continuous liquid stream blender showing a dynamic mixer where increased mixer volume increases blended liquids mixing time.

Also as best seen in FIG. 15, the finished product tank 18 is provided with sufficient volume capacity, generally indicated at 62 to allow the flow of the combined and blended streams to continue uninterrupted until a complete synchronous flow ratio defined operating cycle of the blender has been completed. This tank volume capacity is at least equal to the planned maximum flow volume or mass of one complete synchronous flow cycle of the blender apparatus.

In the preferred form of this invention shown in FIG. 1, the flow meter 50 shown in the primary stream and the flow meters 44 shown in the secondary streams are Coriolis mass flow meters. Alternative flow meter types include volumetric flow meters such as magnetic flow meters. The blender of this specification can also be operated without discrete flow meters in the streams flow pathways, as generally shown in FIG. 2 and FIG. 11. When these embodiments of the invention are used, each stream servo-pump serves as an active displacement volumetric flow controller to volumetrically define a ratio dose delivered in a synchronous flow time. As shown in FIG. 2, encoded servomotors 33 and 39 operate rotary pumps 34 and 40, each to a defined rotation within a defined synchronous run time. The pulse count from encoders 33*e* and 39*e* establish each pump's rotation and thus a volumetric ratio dose, and defines the RPM of each pump. In FIG. 11, linear servo drives 64 and 66 operating respectively on piston pumps 68 and 70 produce defined volumetric ratio displacements in the same general manner as in the rotary pump embodiment shown in FIG. 2, the ratios synchronously combining in an injector assembly in the same manner as in the rotary pump embodiment.

The embodiments of the blender invention shown in FIGS. 1, 2 and 11 disclose two precision ratio dose valves associated with each flow stream or pathway downstream of the associated secondary stream pump. On any given flow stream, each precision shut-off each valve 42A and 42B is identical to the other. The ratio dose valve 42A serves as the cut-off or shut-off valve for ratio dosing of the secondary stream pictured into the blender system streams injector assembly. The identical valve 42B allows the ratio dose from the same flow stream to be accurately collected as a sample dose for calibration and validation purposes. When the blender is being calibrated or operating, both stream valves are never open simultaneously.

The operating methods and apparatus for calibrating and establishing the streams ratio doses and verifying the operating accuracy of the invention will now be described in detail.

When operated in its simplest form (FIG. 2) the blender invention defines flow synchronized volumetric ratio doses using the described servo-pumps 34 and 40. When so configured, the correct and desired ratio dose of the secondary stream servo-pump 40 is first established, followed by calibration and validation of the primary stream ratio dose.

The secondary stream is volumetrically calibrated by collecting and measuring a trial ratio dose from the secondary stream ratio dose valve 42B as shown in FIG. 2. When this sample is taken, the corresponding stream injector valve 42A remains closed by action of electronic controller 46. This secondary stream trial ratio dose is the flow quantity produced by the servo-pump in a fixed synchronous blender system flow run time which is most typically 5000 ms in duration.

The secondary stream sample or test dose may be measured by weight or volume on a scale or by volumetric graduate. In either case, the dose is adjusted either manually or automatically using the blender electronic controls 46 to alter the servo-pump flow rate in unit time.

The purpose of the ratio dose adjustment is to precisely "fit" the required ratio dose into the blender system synchronous flow time. This can be done by adjusting the secondary stream ratio dose flow rate up or down until the described "fit" is achieved. In the volumetric embodiment of the invention, the flow rate of the secondary channel under calibration can be adjusted by several methods. The most preferred method consists of dividing the actual sample ratio dose weight or volume by the formula target ratio dose weight or volume. The resulting decimal ratio is then subtracted from the integer 1.00 to arrive at a servo-pump flow rate correction factor. If the correction factor is positive, flow rate is increased. If it is negative, the flow rate is decreased.

By way of example, consider a volumetric blender of the present invention with a synchronous ratio dose run time of 5000 ms, and a secondary channel target dose of 1000 g., and a first measured trial dose of 400 g. at a servo-pump RPM of 183 (note that the servo-pump encoder frequency can also be used to compute RPM). In this example, the actual sample dose of 400 g. is divided by the target of 1000 g. to yield a decimal ratio of 0.40. This is subtracted from 1.00 to a result of +0.60. The secondary channel servo-pump RPM is then adjusted by controller 46 by 1.60×183 to 292.80 RPM. In the case where piston or diaphragm pumps are used as ratio dosing servo-pumps, it is possible for a single trial dose and adjustment sequence to achieve a precise correspondence of ratio dose delivered in the blender system synchronous flow time. Where rotary type servo-pumps are used, which can exhibit a nonlinear flow rate vs. RPM relationship depending on the rheology of the pumped liquid, the described procedure may need to be repeated more than once to arrive at a fit that is within the engineered tolerances of the blender system.

To calibrate the primary stream ratio dose in the volumetric blender of FIG. 2, all utilized secondary streams are first calibrated as described above. All utilized blender streams, including the primary stream, are then operated synchronously by the controller 46 and the combined synchronous doses are collected by sample valve 52*b*. The total combined synchronous flow ratio dose streams are then measured by weight or volume as with the secondary streams. The weight or volume of each secondary stream ratio dose is then subtracted from the total blended cycle dose to arrive at the ratio dose quantity of the primary stream liquid. The primary stream liquid ratio dose is then adjusted up or down as required using the same analytical and adjustment procedure as described above for a secondary stream.

After the volumetric blender is calibrated as described above, the accuracy of each stream ratio dose and its flow rate matching accuracy with the synchronous flow period of the blender system is checked and adjusted as necessary between each blender flow cycle. Operating volumetrically, the blender of FIG. 2 defines a ratio dose based upon the pulse count generated by encoders 33*e* and 39*e* with each defined time interval ratio dose flow cycle. Thus, at the end of each synchronous flow period, the electronic controller 46 carries out an analysis of the encoder pulse count on each channel to first assure that the dose is correct and second to assure that the dose flow time is synchronous with the blender system run time. On any flow stream, in the event that the pulse count is above or below the calibrated count or value arrived at during the calibration described above, the count for the next run cycle is adjusted by the pulse error number. A gross error greater than some user defined limit can cause an alarm. This cycle by cycle count adjustment assures continuing volumetric dose accuracy from blender cycle to blender cycle.

The synchronization of flow on each stream is also checked between each blender flow cycle. If the ratio dose pulse count on any operating channel is completed before the end of the common synchronous flow time (typically 5000 ms), the flow rate of the channel is too high and it is adjusted downward by an amount proportionate to the undertime as it bears to the synchronous run time. The undertime error above a user defined value can trigger an alarm. In the case where the ratio dose pulse count is not completed before the end of the common synchronous flow time (flow rate too low) the user can select from two correction modes.

In the first, the dose is allowed to complete to the encoder net count even though the synchronous flow period has expired. The flow rate of the channel is then adjusted upward by an amount proportionate to the overtime as it bears to the synchronous time. Alternatively, the stream flow can be terminated at the end of the synchronous flow time even though the ratio dose defined its encoder pulse count value has not been completed. With this method, the flow rate of the channel is adjusted upward by an amount proportionate to the encoder pulse count at the end of the synchronous run time as it bears to the correct encoder count preset arrived at in the calibration procedure. As in the other error cases, an overtime error greater than a user defined value can trigger an alarm. These cycle by cycle synchronous run time adjustments assure continuing precision of matched ratio dose flows from blender cycle to blender cycle.

FIG. 2 electronic controller 46 can also be programmed to signal the blender user after a desired number of synchronous flow cycles have been completed for the particular purpose of prompting the collection of a ratio dose sample from each operating flow stream as a means to periodically validate the ratio dose calibration of each operating flow stream.

With completion of each blender cycle, FIG. 2 electronic controller 46 also provides additional critical checks to assure correct function.

Because the correct encoder pulse count on each stream is known and because, the count correlates to a known ratio dose weight or volume determined by the described calibration procedure, the weight or volume per pulse on each channel is known. This, in turn, allows the FIG. 2 controller 46, after each blender flow cycle, to confirm that the summed ratio doses of all operating secondary streams is less than the summed ratio doses of all operating channels, including the primary stream. This critical intercycle computation assures that no ratio dose flow from operating secondary streams servo-pumps can be displaced into the liquid supply reservoir feeding the primary stream servo-pump.

FIG. 2 electronic controller 46 also assures correct critical sequencing and open-closed position interlocking of the flow streams ratio dose valves during blender operation. In particular, the controller 46 software assures that when blending, the primary stream dose valve and all secondary stream injector assembly ratio dose valves must read open to allow a blender cycle to occur. Further, to prevent the possibility of secondary stream back flow into the primary stream supply or brief asynchronous flow at the start of a synchronous flow cycle, controller 46 assures that a master start-run signal initiates rotation of all operating servo-pumps and that such signal can be propagated only after the primary stream ratio dose valve is read by controller 46 as open. Controller 46 further assures that no servo-pump can operate or continue to operate without both the master start-run signal and the ratio dose valve open status signal. Thus, controller 46 continues to monitor all operating ratio dose valves during a blender flow cycle and aborts the cycle if any valve open status signal is lost or changes state. When in calibration mode, controller 46 also provides necessary logic to address only the correct sample ratio dose valves.

FIG. 1 discloses a blender of the present invention, operating substantially in the same manner as detailed for the servo-pump volumetric embodiment of FIG. 2. However, in FIG. 1, flow meters 44 on the secondary ratio dose streams and 50 on the primary ratio dose stream have been added. These added flow meters can be of any suitable type, but are most preferably Coriolis Mass Flow meters. The use of mass flow meters confers numerous operating advantages to the blender invention.

The flow meters 44 and 50 can be calibrated by operation of the streams sample ratio dose valves as previously described. However, collected ratio doses are weighted and directly compared with the corresponding mass doses shown on the mass meter electronic display 44*a* or as transmitted by the meter to the display at electronic controller 46. The meters' mass ratio doses can then be adjusted to correspond exactly to the collected sample mass ratio doses, thus calibrating the meters. Note that the primary stream mass flow meter may be calibrated directly from flow from the primary stream reservoir. Once the mass meters of the FIG. 1 embodiment have been calibrated, the desired mass ratio dose of each stream can be established, and the blender operated substantially as in the described FIG. 2 embodiment.

In addition to allowing blender cycle by cycle accuracy verification by subtraction of all operating secondary ratio flow mass doses from the primary stream mass dose, the use of Coriolis mass flow meters, which can also function as densitometers, allows a second means of accuracy verification using density readings from meters 44 for each secondary stream and the density reading for the combined and mixed streams on the primary flow channel mass meter 50. Thus, if the ratio for each stream is multiplied by the known density of each stream, and these ratio-times-density values are added together and then divided by 100, the computed density of the finished blended liquid product is known. This value can then be directly compared, on a cycle by cycle basis if desired, with the density reading from mass meter 50 ratio dose to assay blender ratio dose accuracy based on streams densities. Note that the mass meter 50 is located down flow from the streams mixing structure of the invention, assuring that the density reading it produces is from the homogeneous mixing of the constituent streams.

Figure 5:
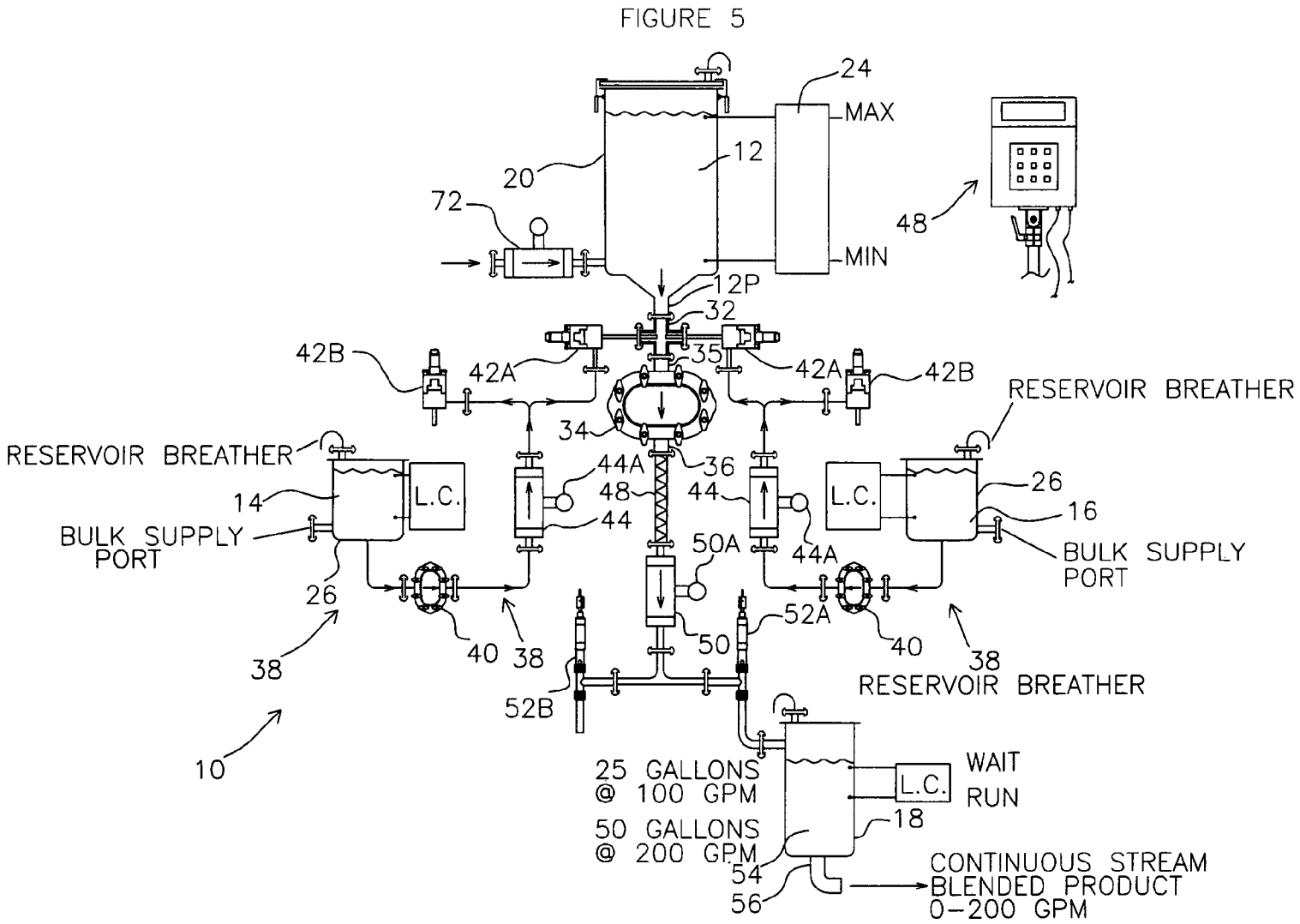
FIG. 5 is a diagrammatic view of a preferred embodiment of the simplified continuous liquid stream blender showing density monitoring of the primary stream liquid bulk supply.

As embodied in FIG. 1, the density of the primary stream liquid must be independently known for this method to be utilized, or the primary stream must be operated with all secondary streams flows disabled until Coriolis mass meter 50 contains only the primary stream liquid, allowing its density to be determined by meter 50. This flow procedure is typically carried out at blender start-up and calibration, with primary stream flow being directed through ratio dose sample valve 52*b*. Alternatively, FIG. 5 discloses the addition of a Coriolis mass meter 72 fitted to the feed supply port proximate to the primary stream reservoir. This embodiment of the blender invention allows the density of the primary stream liquid to be directly monitored by a Coriolis instrument allowing the density computation and comparison described using streams density readings which are all derived from Coriolis instruments.

Figure 7:
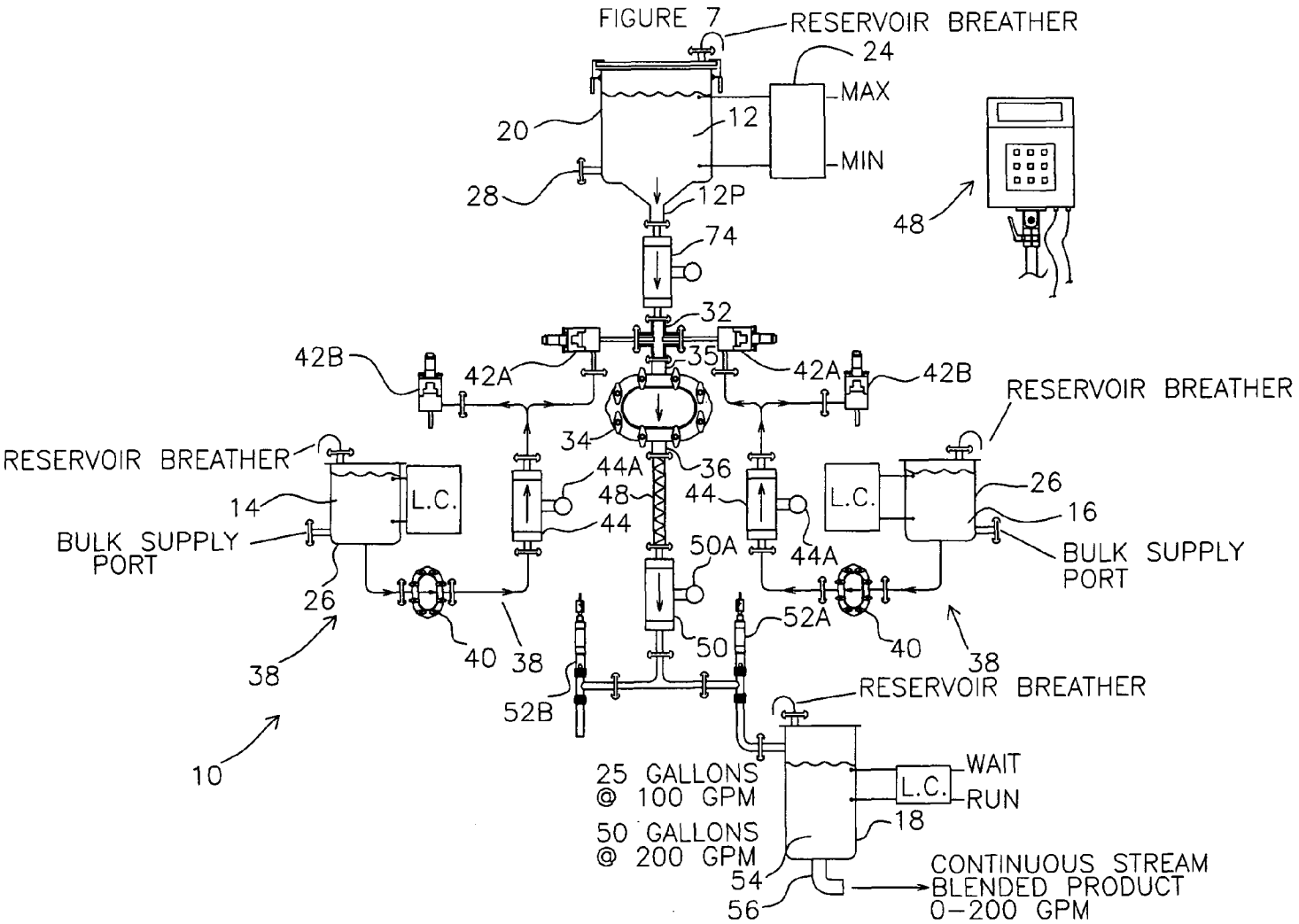
FIG. 7 is a diagrammatic view of a preferred embodiment of the simplified continuous liquid stream blender showing a mass and density monitor inserted into the primary liquid feed to the streams injector assembly.

FIG. 7 discloses an embodiment in which Coriolis mass flow meter 74 is fitted between the discharge port of the primary stream liquid supply and the streams injector assembly. With this arrangement, the cycle by cycle ratio dose of the primary stream is directly known and can be defined and calibrated in the blender synchronous flow time as previously disclosed. This arrangement also allows the density of the primary stream liquid to be known on a cycle by cycle basis, which can be used computationally for density monitoring as previously described. When this arrangement is used, the ratio dose of each operating stream is directly known and can be additively compared with the summed ratio dose readout from meter 50, allowing still an additional means of blender accuracy verification. If desired, meter 50 can also be omitted with this embodiment. When this arrangement shown in FIG. 7 is used, care must be taken that the primary stream liquid does not vacuum cavitate under the suction flow induced by the primary stream servo-pump as a result of increased flow resistance presented by meter 74.

Figure 8:
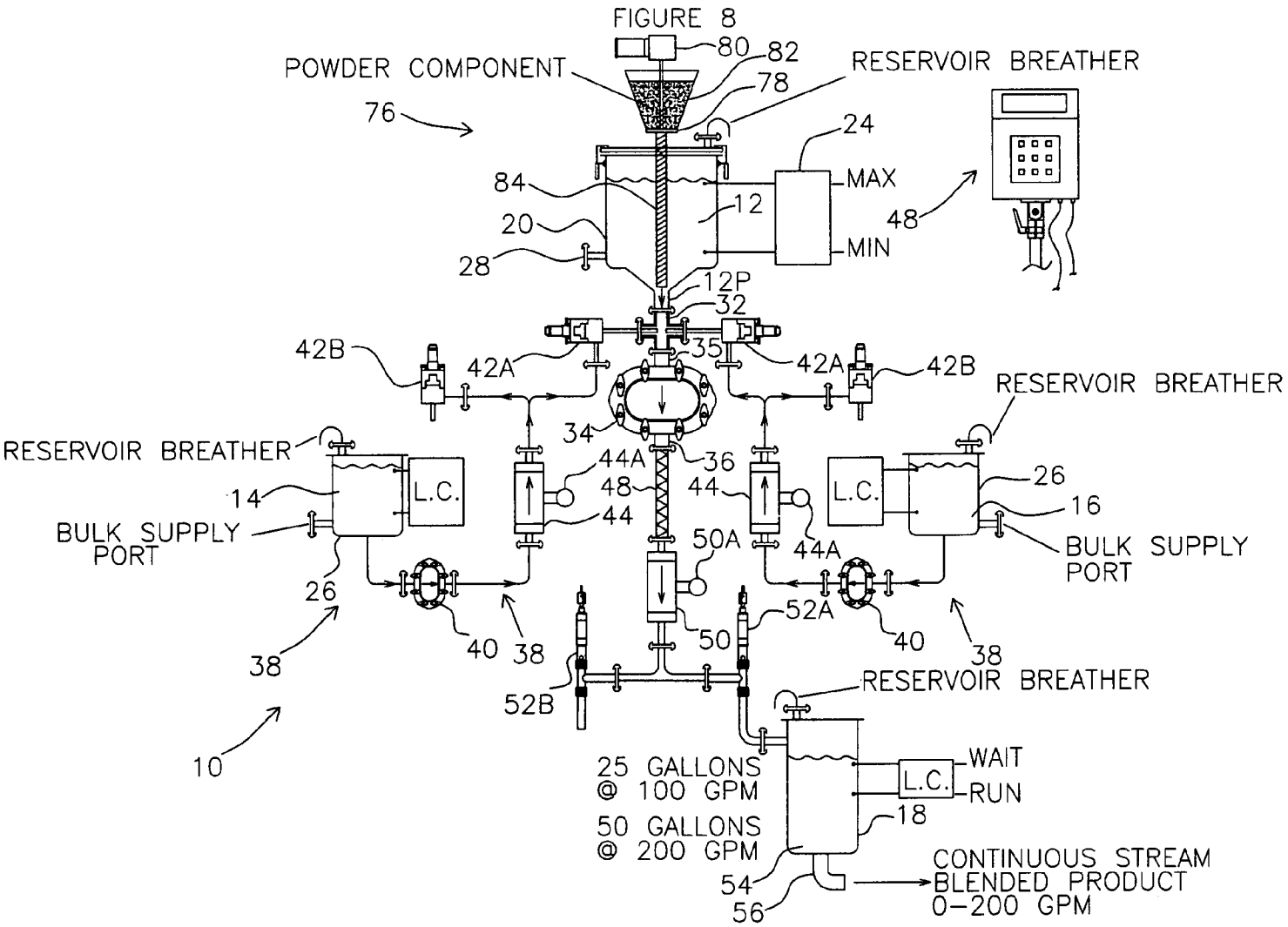
FIG. 8 is a diagrammatic view of an embodiment of the simplified continuous liquid stream blender showing apparatus for adding a solids component stream to the blender invention.
Figure 9:
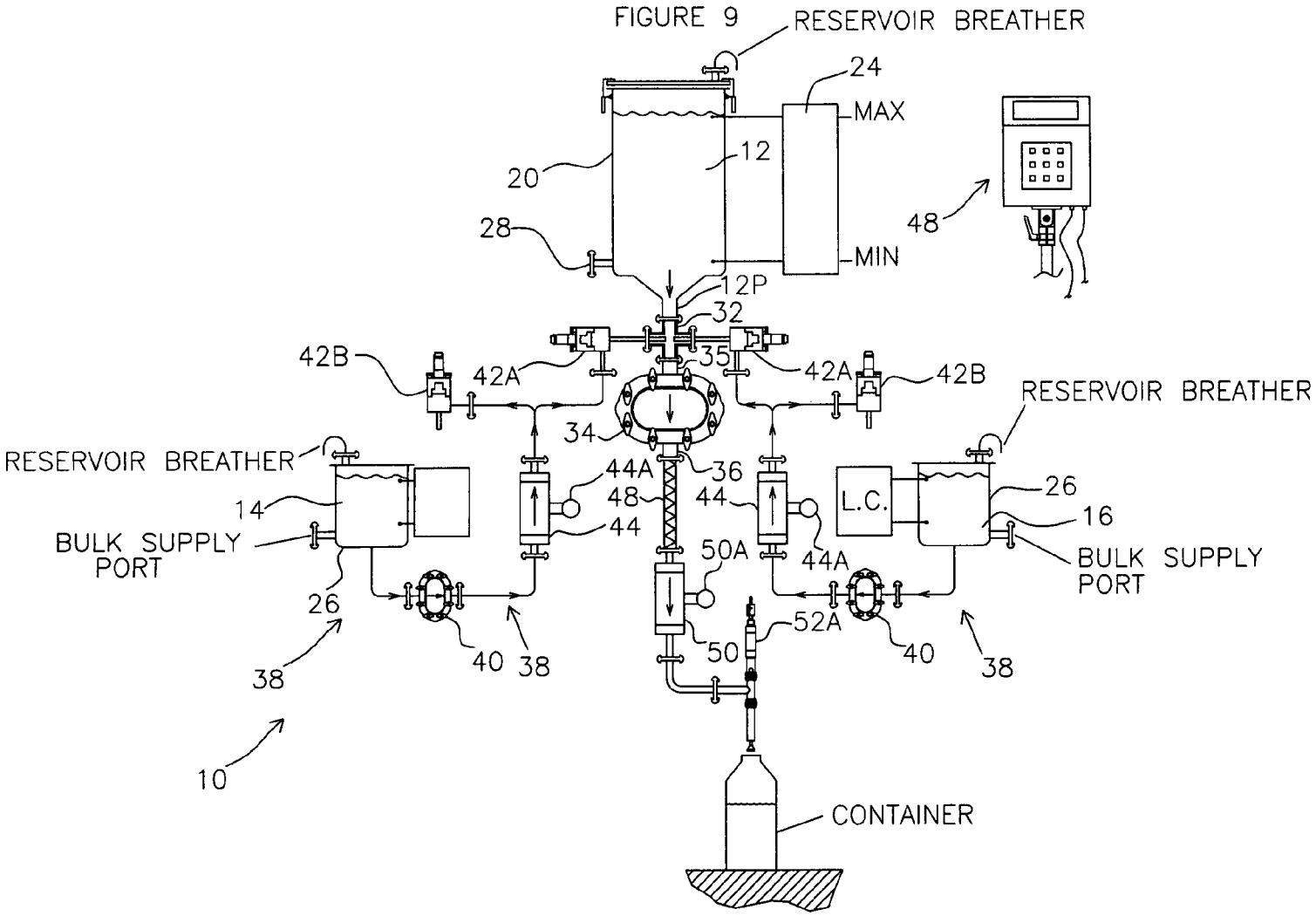
FIG. 9 is a diagrammatic view of an embodiment of the simplified continuous liquid stream blender showing the dosing of blended liquid into a unit of use container.

In FIG. 8, the embodiment of FIG. 1 is changed with the addition of a solids ratio dose apparatus, generally indicated at 76, in addition to the liquids capability previously disclosed. Many liquid product formulas are comprised of both liquid constituents as well as solid constituents. When this is the case, the embodiment of FIG. 8 can be used. The solids ratio dosing apparatus disclosed is an essentially conventional auger filler 78 commonly used to volumetrically dose solids. Its operation is akin to the rotary servo-pump liquid dosers, where a servo drive 80 displaces a powder or granular material contained in supply hopper 82 by control of auger 84 speed and rotation. The apparatus shown in FIG. 8 typically operates synchronously with the other liquid stream(s). The device can also be fitted with a progressing cavity type pump instead of the auger for the purpose of synchronous ratio dosing of viscous pastes containing solids.

Figure 13A:
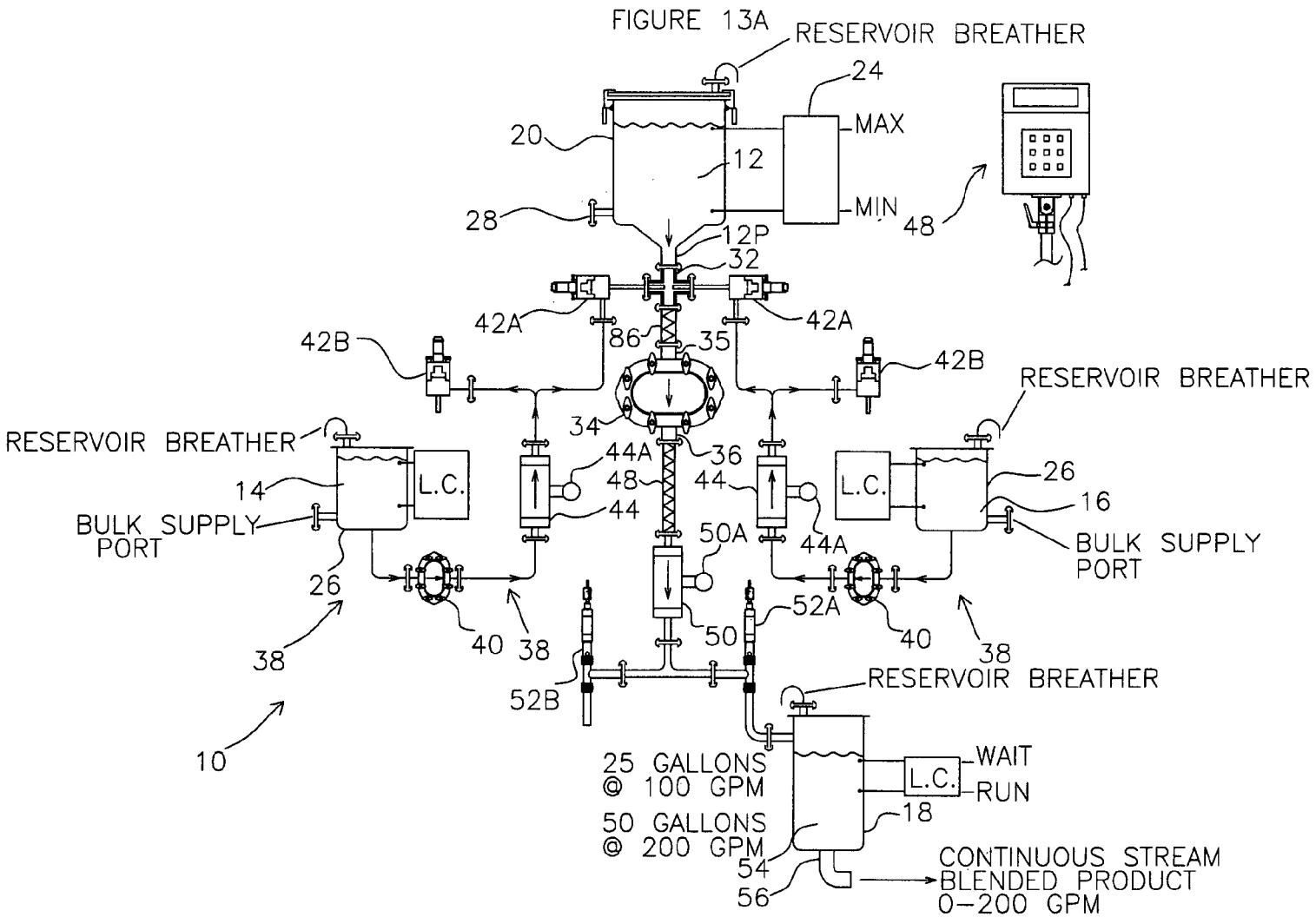
FIG. 13A is a diagrammatic view of the simplified continuous liquid stream blender showing a mixing element inserted between the streams injector assembly and the primary stream pump.
Figure 13B:
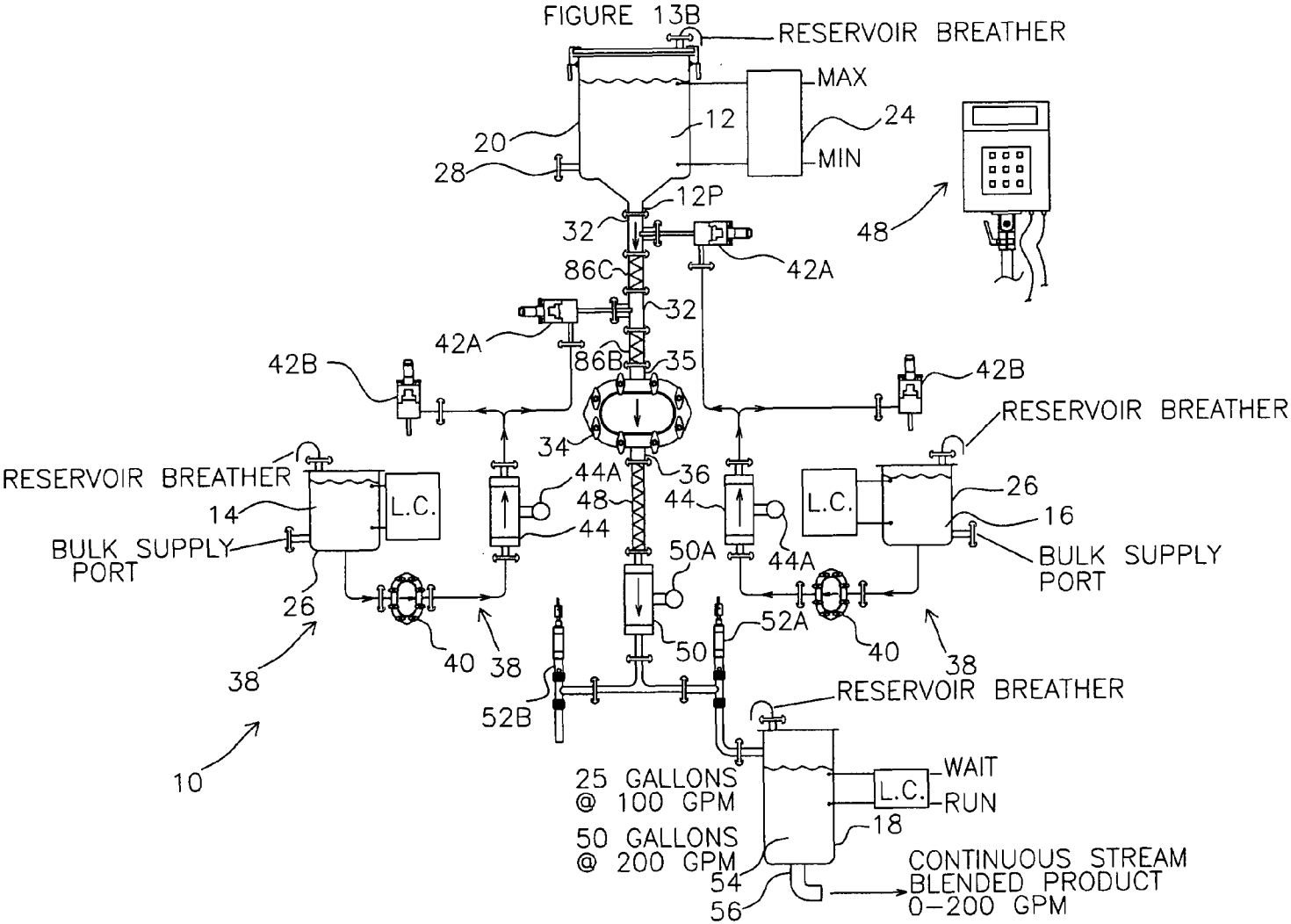
FIG. 13B is a diagrammatic view of the simplified continuous liquid stream blender showing mixing elements interspersed with streams injector assemblies.

FIGS. 13A and 13B disclose embodiments of the blender invention wherein mixing devices 86 and 88, typically static or in-line ribbon types, are inserted into the flow lumen of the streams injector assembly to increase the amount of initial mixing of the synchronously dosed ratio streams prior to their suction displacement into the primary stream pump. FIG. 13A shows mixing of all secondary streams with the primary stream liquid prior to their synchronous flow into the primary pump. FIG. 13B shows sequential mixing of these streams with the primary stream at 86*a* and then subsequent mixing of these streams with another secondary stream closer to the primary stream pump at 86*b*. When these arrangements are utilized, care must be taken to assure that the combining liquid streams do not vacuum cavitate under the suction flow induced by the primary streams pump as a result of the increased flow resistance presented by the suction side positioned mixing element(s). In cases where this could occur, the injector assembly 32, the mixing elements 86, and the pump suction port 35 can be increased in flow diameter. The primary liquid supply reservoir 12 can also be pressurized or fitted with a feed forcing diaphragm, piston or ram (not illustrated). The primary liquid stream reservoir 12 outfeed port 12*p* can also be increased in flow diameter.

FIGS. 10A through 10F illustrate the numerous unique and novel embodiments of streams injector assemblies useable with this blender invention. FIG. 10A illustrates secondary streams points of injection into the streams injection assembly in direct opposition to one another. 10B illustrates a staggered or offset arrangement. 10C illustrates angular presentations with both straight and angle cut dose tube ends. 10D illustrates a dose tube with a blocked distal end and stream flow from a plurality of holes along the length of the dose tube. 10E illustrates two types of precision ratio dose valves, one where the shutoff at the end of the flow tube opens outward into the injector assembly lumen, and one where the shutoff moves inward into the flow tube. FIG. 10F illustrates the modular stacking of precision ratio dose valves using clamped together or flanged sections of the streams injector assembly, allowing points of synchronous streams addition to be added or deleted to the streams injector assembly.

Figure 6:
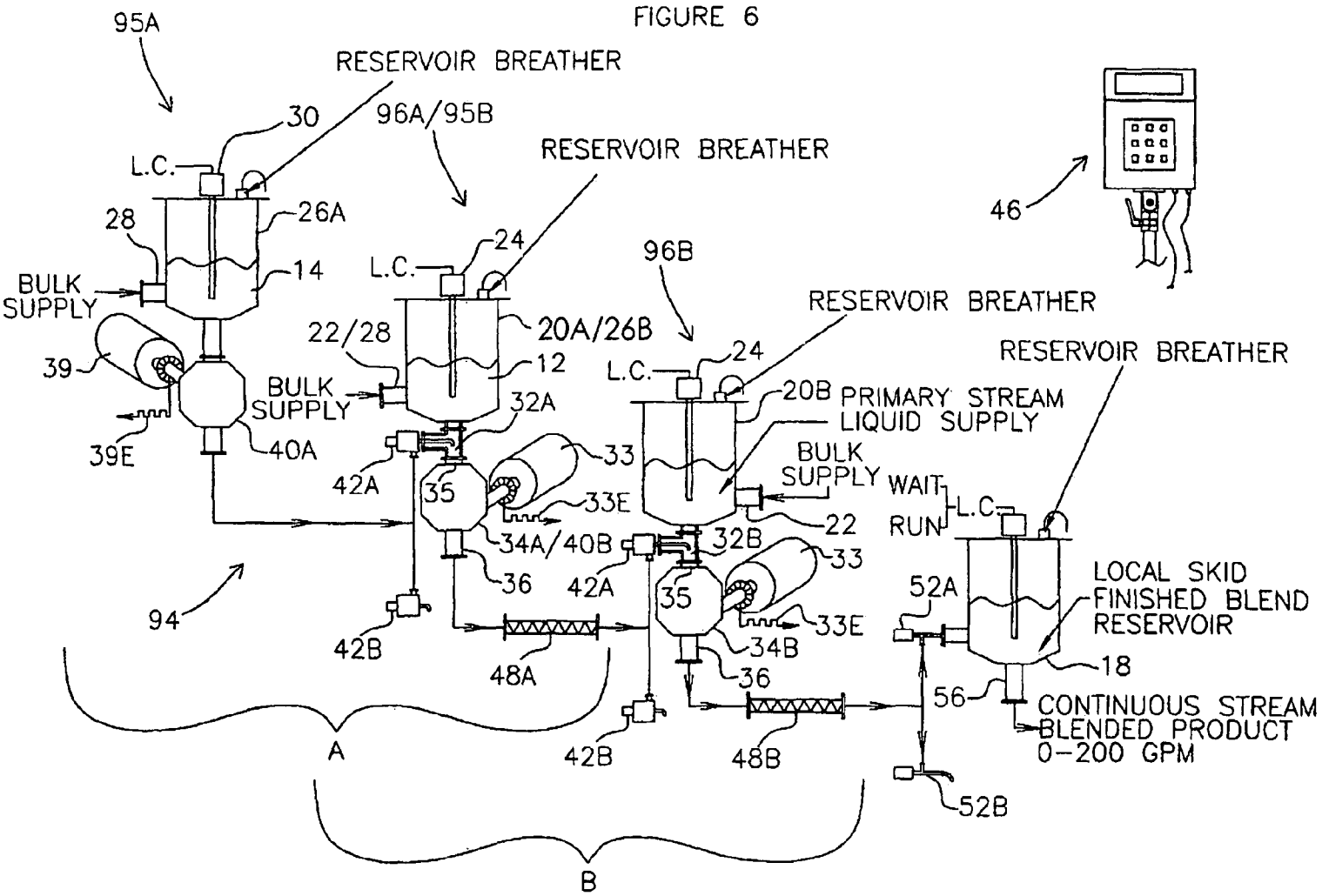
FIG. 6 is a diagrammatic view of a cascaded embodiment of the simplified continuous liquid stream blender.

In FIG. 6, the coupling or cascading of blenders is illustrated. Recall that within the scope of the invention herein, a blender consists of one primary flow stream and at least one secondary flow stream. Thus, FIG. 6 shows a first blender generally indicated at 94, consisting of a secondary stream assembly 95 and the primary stream assembly generally indicated at 96. For clarity, the first blender secondary stream is supplied by reservoir 26A flowing into ratio dosing servo-pump 40A. The primary stream assembly 96 of the first blender is supplied by reservoir 20/26 flowing into ratio dosing servo-pump 40B.

The second or cascaded blender "B" illustrated in FIG. 6, consists of a secondary stream assembly indicated generally as 95B and the primary stream assembly indicated generally at 96B. The secondary stream assembly 95B of the second cascaded blender "B" is supplied by reservoir 26B flowing into ratio dosing servo-pump 40B. The primary stream assembly 96B of the second blender is supplied by reservoir 20B flowing into ratio dosing servo-pump 34B. It will be understood that the fluids which pass through the static or dynamic in-line mixer 48A of the first blender "A" constitutes the secondary stream of the second blender. In effect, this blender stream assembly 96A/95B is shared between the two blenders "A" and "B". Thus, the ratio dose combined liquids from reservoir 26A and from reservoir 20A/26B flow through mixing apparatus 48A under the propulsion of pump 40B and into the streams injector assembly 32B of the primary stream of the second blender "B".

As can be readily understood in FIG. 6, the cascaded blenders are hydraulically interconnected and the synchronous flow time is common to all streams in the combined two blender apparatus illustrated. Each blender stage can have as many secondary streams as required by formula, and as many blender stages can be coupled as is required by formula. This arrangement is particularly advantageous in allowing sequential mixing and sequential additions that may be functionally required to achieve correct formulation.

While a preferred form of this invention has been described above and shown in the accompanying drawings, it should be understood that applicant does not intend to be limited to the particular details described above and illustrated in the accompanying drawings, but intends to be limited only to the scope of the invention as defined by the following claims. In this regard, the term "means for" when used in the claims is intended to include not only the designs illustrated in the drawings of this application and the equivalent designs discussed in the text, but it is also intended to cover other equivalents now known to those skilled in the art, or those equivalents which may become known to those skilled in the art in the future.

What is claimed is:

1. A method for continuous liquid stream blending wherein two or more liquids are repeatedly synchronously ratio dosed together to form a batch or blend of desired mixture ratios or proportions, the method comprising the following:

providing an encoded servo driven primary stream liquid ratio dosing pump discretely and separately controllable and operable the primary stream liquid ratio dosing pump having an infeed port;

providing a level controlled primary stream liquid reservoir having a bottom outfeed hydraulically connected to the infeed port of the primary stream liquid ratio dosing pump;

providing one or more secondary stream liquid ratio dosing pumps, each having an encoded servo drive and an infeed port, each secondary stream dosing pump servo drive separately and discretely controllable and operable;

providing a tubular hydraulic streams injector assembly hydraulically connecting the bottom outfeed to the infeed port of the primary stream ratio dosing pump, the injector assembly having liquid connections coupling an encoded secondary stream pump ratio dosing valve for each secondary stream ratio dosing pump;

providing one or more level controlled secondary stream reservoirs, each having a bottom outfeed port closely connected to the infeed port of the one or more secondary stream liquid ratio dosing pump;

providing a finished blended product tank having a level sensor signaling the synchronous running or stopping of all ratio dosing pumps, the finish blend product tank having sufficient capacity to receive all combined ratio doses in process when a level sensor stop signal occurs, and capable of providing a continuous outflow of ratio combined and blended liquids;

providing an encoded primary stream dosing valve, mounted to the finished blended product tank and controlling the inflow of combined ratio doses from the primary stream liquid ratio dosing pump discharge into the finished blended product tank;

operating the primary stream ratio dosing pump and primary stream pump ratio dosing valve simultaneously with one or more secondary ratio dosing pumps and secondary stream pump ratio dosing valves for an electronically predetermined synchronous run time to cause a liquid ratio dose from the primary stream liquid reservoir and liquid ratio doses from the secondary streams liquid reservoirs to simultaneously flow together in the streams injector assembly and then into the primary stream ratio dosing pump and to be displaced out of the primary stream ratio dosing pump and through a single inlet-single outlet liquid mixing device and then though the primary stream dosing valve and into the finished blended product tank; and defining a desired no flow off time between each successive synchronous run time.

2. The method for continuous liquid stream blending as set forth in claim 1 further characterized by the provision of sampling stations for each of the secondary streams and the primary stream whereby direct stream ratio dose sampling is possible because of the repeatable and stable back pressure produced by each stream, and because each stream back pressure is non-interactive with any other.

3. The method for continuous liquid stream blending as set forth in claim 1 wherein each ratio dosing pump can be separately and discretely controlled to establish a volumetric ratio dose.

4. The method for continuous liquid stream blending as set forth in claim 2 further characterized by the provision of a stream ratio dose sample valve associated with each sampling station.

5. The method for continuous liquid stream blending as set forth in claim 1 further characterized by the provision of one or more streams mixing means located within the streams injection assembly or downstream of the streams injection assembly but before the suction side port of the primary stream pump, the method further comprising the additional steps of operating the primary stream pump to cause flow through the streams mixing means.

6. The method for continuous liquid stream blending as set forth in claim 5 in which the operation of the streams mixing means may be established or altered independently of and without changing the operating secondary streams ratio doses.

7. The method for continuous liquid stream blending as set forth in claim 1 further characterized by the additional step of discretely and independently changing the ratio flow dose flow rate or dose size or liquid rheology or discharge pressure or configuration or size of any secondary steam as required, without altering operation of any other secondary stream.

8. The method as set forth in claim 1 wherein the streams injection assembly is tubular in flow cross section, and wherein the liquid ratio dose streams are combined synchronously at ratio matched flows within the tubular cross section of the injector assembly.

9. The method as set forth in claim 1 wherein flow of all of the ratio defined and synchronized doses through the primary stream pump contributes to the dose combining and mixing due to the mixing action of the pump.

10. The method as set forth in claim 2 wherein priming with liquids is accomplished sequentially wherein:

first, each respective liquid supply reservoir is charged with liquid to the indicated maximum level of the reservoir liquid level control;

second, the primary stream is primed to a fully hydraulic condition to achieve flow into the finished blend tank and also from the discharge of the primary sampling station;

third, each secondary stream is primed to a hydraulic condition based upon its lumen volume until a fully hydraulic condition is achieved allowing flow into the lumen of the injector assembly and also from the secondary stream sampling station;

fourth, operating all functioning ratio streams synchronously to displace ratio blended flow from the primary stream sampling station thus allowing calibration of each stream and the finished blend liquid; and fifth, synchronously ratio dose operating all functioning streams to effect displacement of correctly blended liquid into the finished blend tank; this priming and charging sequence minimizing the consumption of all constituent liquids and minimizing the volume of unblended or incorrectly blended liquid entering the finished blend tank.

11. The method as set forth in claim 1 wherein the primary and secondary ratio dose pumps are dose operated simultaneously for a predetermined and common dose time at proportionately increased flow rates or at a proportionately increased dose time to increase the stream volume or mass dose of each synchronous ratio defined digital dose for the purpose of improving the stream ratio dose repeatability expressed as a plus or minus percentage of a ratio dose sample group mean.

12. The method for continuous liquid stream blending as set forth in claim 1 further characterized by providing volumetric liquid flow meters inserted into the pump discharge flow pathway of each secondary stream and in the discharge flow pathway of the primary stream ratio dosing pump whereby volumetric ratio dose operation can be achieved.

13. An apparatus for continuous liquid stream blending wherein two or more liquids are repeatedly synchronously ratio dosed together to form a batch or blend of desired mixture ratios or proportions, the apparatus comprising the following:

an encoded servo driven primary stream liquid ratio dosing pump discretely and separately controllable and operable, the primary stream liquid ratio dosing pump having an infeed port;

a level controlled primary stream liquid reservoir having a bottom outfeed hydraulically connected to the infeed port of a primary stream liquid ratio dosing pump;

one or more secondary stream liquid ratio dosing pumps, each having an encoded servo drive and an infeed port, each secondary stream dosing pump servo drive separately and discretely controllable and operable;

a tubular hydraulic streams injector assembly hydraulically connecting the bottom outfeed to the infeed port of the primary stream ratio dosing pump, the injector assembly having liquid connections coupling an encoded secondary stream pump ratio dosing valve for each secondary stream ratio dosing pump;

one or more level controlled secondary stream reservoirs, each having a bottom outfeed port closely connected to the infeed port of the one or more secondary stream liquid ratio dosing pump;

a finished blended product tank having a level sensor signaling the synchronous running or stopping of all ratio dosing pumps, the finished blend tank having sufficient capacity to receive all combined ratio doses in process when a level sensor stop signal occurs, and providing a continuous outflow of ratio combined and blended liquids;

an encoded primary stream dosing valve, mounted to the finished blended product tank and controlling the inflow of combined ratio doses from the primary stream liquid ratio dosing pump discharge into the finished blended product tank;

electronic control apparatus for operating the primary stream ratio dosing pump and primary stream pump ratio dosing valve simultaneously with one or more secondary ratio dosing pumps and secondary stream pump ratio dosing valves for an electronically predetermined synchronous run time to cause a liquid ratio dose from the primary stream liquid reservoir and liquid ratio doses from the secondary streams liquid reservoirs to simultaneously flow together in the streams injector assembly and then into the primary stream ratio dosing pump and to be displaced out of the primary stream ratio dosing pump and through a single inlet-single outlet liquid mixing device and then though the primary stream dosing valve and into the finished blended product tank;

the control apparatus also defining a desired no flow off time between each successive synchronous run time.

14. The apparatus as set forth in claim 13 further including means to independently and selectively turn the ratio dose streams on and off as desired and in any combination to alter the ratio dosed constituent streams as desired.

15. The apparatus as set forth in claim 13 further including a sampling station for each of the secondary streams and the primary stream.

16. The apparatus as set forth in claim 13 further including liquid flow meters inserted into the pump discharge flow pathway of each stream.

17. The apparatus as set forth in claim 15 further including a stream sample valve associated with each sampling station, and further including a stream injection or ratio dose valve in each liquid ratio flow dose stream, each stream sample valve being essentially identical to the corresponding stream ratio dose valve.

18. The apparatus as set forth in claim 13 wherein each reservoir is level controlled, each reservoir being proximate to each stream ratio dosing pump.

19. The apparatus as set forth in claim 18 wherein each stream liquid supply reservoir is provided with a liquid level control allowing liquid level within the reservoir to be maintained at a defined and known liquid level or within a defined and known liquid level range, thus establishing a definite and known stable liquid feed or supply pressure or pressure range to each stream pump, thus helping to assure accurate and stable operation of the apparatus for continuous liquid stream blending.

20. The apparatus as set forth in claim 13 wherein each reservoir is maintained at atmospheric pressure.

21. The apparatus as set forth in claim 13 wherein one or more streams mixing means can be located within the streams injection assembly or downstream of the streams injection assembly, but before the suction side infeed port of the primary stream ratio dose pump.

22. The apparatus as set forth in claim 13 wherein the streams injection assembly is located between the liquid supply reservoir of the primary stream and attached directly to the infeed port of the primary stream pump.

23. The apparatus as set forth in claim 13 further including a single electronic control apparatus which serves to operate and synchronize the ratio matched dose flows of all functioning streams within the apparatus for continuous liquid stream blending.

24. The apparatus as set forth in claim 13 in which a suitably sized densitometer is fitted between the outfeed port of the primary stream liquid supply reservoir before the streams injection assembly, such that all secondary stream points of injection are down-flow from the densitometer, thus allowing the density of the primary stream liquid flowing into the primary stream ratio dosing pump to be known.

25. The apparatus as set forth in claim 13 in which a liquid flow meter is located between the outflow port of the primary stream liquid supply reservoir and the streams injection assembly to allow the volume or mass ratio dose of the primary stream liquid flowing into the primary stream ratio dosing pump to be known directly with each blender synchronous ratio dose cycle.

26. The apparatus as set forth in claim 13 further characterized by the provision of a suitable densitometer located in the discharge flow pathway of the primary stream pump, distal to all streams mixing elements or apparatus, whereby the density of the blended streams can be directly measured.

27. The apparatus as set forth in claim 13 further characterized by the provision of a suitable volumetric or mass liquid flow meter located in the discharge pathway of the primary stream pump, distal to all streams mixing elements or apparatus, whereby the volume or mass of the blended streams ratio doses can be directly measured.

28. The apparatus as set forth in claim 13 further characterized by the provision of a suitable densitometer located in the flow pathway of each secondary stream pump, whereby the density of the secondary stream liquids can be directly measured.

29. The apparatus as set forth in claim 13 further characterized by the provision of a suitable volumetric or mass liquid flow meter located in the discharge pathway of each secondary stream pump, whereby the volume or mass of the secondary stream ratio doses can be directly measured.

30. The apparatus as set forth in claim 13 further characterized by the provision of a secondary stream sample valve whereby the density of a secondary flow stream liquid can be determined by weighing a known volume ratio dose collected from the secondary stream sample valve.

31. The apparatus set forth in claim 13 wherein a Coriolis mass flow meter is located in the primary stream pump discharge and distal to a streams mixing apparatus, wherein the Coriolis mass flow meter can define the total primary stream synchronous dose, and also measure, without the need for any additional apparatus, the completeness and efficacy of liquid streams blending and mixing by measuring the magnitude of density changes of the combined streams flowing through the Coriolis mass flow meter during synchronous digital flow.

32. The apparatus set forth in claim 13 further characterized by the provision of means capable of detecting air or gas inclusions in a liquid stream, generally referred to as slug flow, and means to immediately inhibit blender operation and to alarm the existence of such conditions, thereby preventing inaccurate ratio blending of constituent liquid streams.

33. The apparatus set forth in claim 13 further characterized by the provision of means to prevent operation whenever the volumetric or mass sum of the operating secondary streams ratios is equal to or greater than 100% of the blended liquids ratio formula, thus preventing the possibility of flow of secondary stream liquids into the primary stream liquid supply.

34. The apparatus as set forth in claim 16 wherein the liquid flow meters are volumetric liquid flow meters whereby volumetric ratio dose operation can be achieved.

35. The apparatus as set forth in claim 16 wherein the liquid flow meters are mass liquid flow meters whereby mass ratio dose operation can be achieved.

36. The apparatus as set forth in claim 13 further including mass liquid flow meters inserted into the pump discharge flow pathway of each secondary stream and between the outfeed port of the primary stream ratio dose liquid supply reservoir and the streams injection assembly whereby mass ratio dose operation can be achieved.

37. The apparatus as set forth in claim 13 further including volumetric liquid flow meters inserted into the pump discharge flow pathway of each secondary stream and between the outfeed port of the primary stream ratio dose liquid supply reservoir and the streams injection assembly whereby volumetric ratio dose operation can be achieved.

* * * * *